US008236474B2

(12) United States Patent
Kawase et al.

(10) Patent No.: US 8,236,474 B2
(45) Date of Patent: Aug. 7, 2012

(54) METHOD FOR MANUFACTURING TONER, TONER, DEVELOPER, DEVELOPING DEVICE AND IMAGE FORMING APPARATUS

(75) Inventors: Yoshitaka Kawase, Osaka (JP); Takashi Hara, Osaka (JP); Yoshiaki Akazawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 488 days.

(21) Appl. No.: 12/556,996

(22) Filed: Sep. 10, 2009

(65) Prior Publication Data

US 2010/0061767 A1 Mar. 11, 2010

(30) Foreign Application Priority Data

Sep. 11, 2008 (JP) ..... P2008-233978

(51) Int. Cl.
*G03G 9/08* (2006.01)

(52) U.S. Cl. ..... 430/137.11; 430/137.1

(58) Field of Classification Search ..... 430/137.1, 430/137.11

See application file for complete search history.

(56) References Cited

U.S. PATENT DOCUMENTS

| | | | | |
|---|---|---|---|---|
| 4,915,987 | A | 4/1990 | Nara et al. | |
| 5,296,266 | A | 3/1994 | Kunugi et al. | |
| 2008/0166156 | A1 * | 7/2008 | Kawase | 399/222 |
| 2008/0277490 | A1 | 11/2008 | Kinoshita et al. | |

FOREIGN PATENT DOCUMENTS

| | | |
|---|---|---|
| JP | 64-42660 | 2/1989 |
| JP | 4-211269 | 8/1992 |
| JP | 5-10971 | 2/1993 |
| JP | 6-118688 A | 4/1994 |
| JP | 2008-304901 | 12/2008 |

* cited by examiner

*Primary Examiner* — Hoa V Le

(74) *Attorney, Agent, or Firm* — Nixon & Vanderhye, P.C.

(57) ABSTRACT

A method for manufacturing a toner is provided. The method for manufacturing a toner uses a rotary stirring apparatus. The rotary stirring apparatus includes at least a circulation section, a temperature regulation section and a spraying section composed of a two-fluid nozzle. The two-fluid nozzle includes a liquid pipe and an air pipe, the liquid pipe is inserted in the air pipe such that an axis of the liquid pipe coincides with an axis of the air pipe, and at least a part of the liquid pipe and the air pipe is fixed such that the centers of those pipes do not move. A substance in liquid form is sprayed in constant rate from the two-fluid nozzle while regulating temperature and circulating the toner base particles and the fine resin particles in a powder passage, thereby forming a film on the surface of the toner base particle.

8 Claims, 8 Drawing Sheets

METHOD FOR MANUFACTURING TONER, TONER, DEVELOPER, DEVELOPING DEVICE AND IMAGE FORMING APPARATUS

CROSS-REFERENCE TO RELATED APPLICATION

This application claims priority to Japanese Patent Application No. 2008-233978, which was filed on Sep. 11, 2009, the contents of which are incorporated herein by reference in their entirety.

BACKGROUND OF THE INVENTION

1. Field of the Invention

The present invention relates to a method of manufacturing a toner, the toner, a developer, a developing device, and an image forming apparatus.

2. Description of the Related Art

Conventionally, a surface modification treatment for coating the surface of powder particles with a coating material has been performed in order to improve characteristics of the powder particles such as toner particles.

As a method for the surface modification treatment of the powder particles such as toner particles, a method is known that a mechanical stirring force is applied to the powder particles by a rotary stirring section such as a screw, a blade, or a rotor to fluidize the powder particles in a powder flowing passage and a coating material is ejected from a spray nozzle to the powder particles in a fluidized state. For example, Japanese Examined Patent Publication JP-B2 5-10971 (1993) discloses a surface modification method of solid particles in which a rotary stirring section is rotated at peripheral speed of 5 to 160 m/sec to fluidize powder particles and a liquid is sprayed from a spray nozzle to the powder particles in a fluidized state to adhere fine solid particles contained in the liquid to surface of the powder particles or to form a film of a coating material contained in the liquid on the surface of the power particles. According to the surface modification method disclosed in JP-B2 5-10971, adhesiveness between the coating material and the powder particles is able to be improved and time required for the surface modification treatment is able to be shortened.

Further, Japanese Unexamined Patent Publication JP-A 4-211269 (1992) discloses a method for manufacturing a microcapsule in which resin particles are adhered to the surface of inner core particles and are treated with a solvent that dissolves the resin particles to form a coating layer on the surface of the inner core particles. The method for manufacturing a microcapsule disclosed in JP-A 4-211269 comprises at least a step of adhering the resin particles to the surface of the inner core particles, a step of treating resin particles with a solvent that dissolves the resin particles, and a step of drying and collecting the treated particles.

However, in the production method disclosed in JP-B2 5-10971, aggregation of powder particles and coating material is caused depending on the structure of spray nozzle. In the case of using a spray nozzle having a structure such that the spray nozzle comprises a liquid pipe and an air pipe, the liquid pipe is inserted in the air pipe such that an axis of the liquid pipe coincides with an axis of the air pipe, and liquid is blown about by pressure of air at the tip of the spray nozzle to atomize the liquid, when circulation wind, powder particles, coating material and the like collide with the spray nozzle, deviation occurs in central axes of the liquid pipe and the air pipe, and bias is generated in air flow per unit area in the cross-section of an ejection port of the air pipe. Then a spraying direction of liquid is greatly changed, and the liquid is difficult to be gasified. As a result, liquid concentration in a powder passage is greatly changed, and dew condensation due to rapid increase in liquid concentration, aggregation of toner base particles with each other, and adhesion of the particles to a powder passage may occur.

Since the treatment is performed by using the solvent that dissolves a resin of the resin particles in the method disclosed in the JP-A 4-211269, the solvent taken in the resin of the resin particles hardly vaporizes and a large amount of the aggregates are generated even when the inner core particles and the resin particles are fluidized at high speed. Further, large amounts are adhered to the inner wall of the apparatus, which are difficult to be collected in a state of primary particles, and the method does not provide excellent productivity. There is a possibility that some kinds of solvents dissolve even the inner core particles so that waxes contained in the inner core particles and the like are adhered and exposed to the surface of the inner core particles as particles, and when using the obtained microcapsule particles as a toner, toner performance including storing performance and fixing performance of the toner is deteriorated.

SUMMARY OF THE INVENTION

An object of the invention is to provide a method for manufacturing a toner, capable of manufacturing a toner in which a surface of a toner base particle is uniformly coated with fine resin particles in high yield by suppressing adhesion of toner base particles to an inner wall of an apparatus and generation of an aggregate thereof, a toner manufactured by the method for manufacturing a toner; a developer containing the toner; a developing device using the developer; and an image forming apparatus.

The invention provides a method for manufacturing a resin layer-coated toner using a rotary stirring apparatus that comprises:

a circulation section which repeatedly circulates a toner base particle and fine resin particles in a powder passage comprising a rotary stirring chamber and a circulation pipe by a rotary stirring section comprising a rotary disk having rotating vanes provided on a circumference thereof and a rotary shaft and returns those particles to the rotary stirring chamber;

a temperature regulation section which is provided in at least a part of the powder passage and regulates the temperature in the powder passage and the temperature of the rotary stirring section to a given temperature; and a spraying section comprising a two-fluid nozzle which sprays a substance in liquid form for assisting adhesion between the toner base particle and the fine resin particles from a liquid pipe and sprays a carrier gas from an air pipe, the two fluid nozzle comprising a liquid pipe and an air pipe, the liquid pipe being inserted in the air pipe such that an axis of the liquid pipe coincides with an axis of the air pipe, and at least a part of the liquid pipe and the air pipe being fixed such that centers of those pipes do not move, the method comprising:

spraying the substance in liquid form in a constant rate from the two-fluid nozzle while regulating the temperature and circulating the toner base particle and the fine resin particles, in the powder passage, and thereby forming a film on a surface of the toner base particle.

According to the invention, the rotary stirring apparatus is used in the method for manufacturing a resin layer-coated toner, and the rotary stirring apparatus comprises the circulation section, the temperature regulation section and the spraying section. The spraying section comprises the two-fluid nozzle which sprays a substance in liquid form for assisting adhesion between the toner base particle and the fine resin particles from the liquid pipe and sprays a carrier gas from the air pipe. The two-fluid nozzle comprises the liquid pipe and the air pipe, the liquid pipe is inserted in the air pipe such that an axis of the liquid pipe coincides with an axis of the air pipe, and at least a part of the liquid pipe and the air pipe is fixed such that the centers of those pipes do not move.

In the rotary stirring apparatus, the substance in liquid form for assisting adhesion between the toner base particle and the fine resin particles is sprayed in a constant rate from the two-fluid nozzle while regulating the temperature and repeatedly circulating the toner base particle and the fine resin particles, in the powder passage. In this case, the fine resin particles can be plasticized by the synergistic effect of the circulation section and the temperature regulation section, thereby forming a film on the toner base particle. When the two-fluid nozzle fixed such that the centers of the liquid pipe and the air pipe do not move is used in the production method of the toner, even though circulating wind, and the circulating a toner base particle and fine resin particles collide with the two-fluid nozzle, the centers of the liquid pipe and the air pipe can be prevented from moving. Due to this, the amount of a carrier gas sprayed per unit area is constant and is stabilized in the cross-section of the tip of the air pipe. As a result, the direction of the substance in liquid form sprayed and the spraying amount can be suppressed from being changed, and a stable spraying state can be maintained. Therefore, a substance in liquid form concentration in the powder passage can be maintained constant, and a toner having uniform film state and particle size distribution can be manufactured in a stable manner over a long period of time.

Further, in the invention, it is preferable that the method for manufacturing a toner comprises:

a temperature regulation step of regulating the temperature in the powder passage and the temperature of the rotary stirring section to a given temperature by a temperature regulation section;

a fine resin particle adhesion step of introducing the toner base particle and the fine resin particles into the powder passage in which the rotary stirring section is rotated, thereby adhering the fine resin particles to the surface of the toner base particle;

a spraying step of spraying a substance in liquid form which plasticizes the toner base particle and the fine resin particles to those particles in a fluidized state by a carrier gas; and a film-forming step of continuing rotation of the rotary stirring section until the fine resin particles adhered to the toner base particle get soft and form a film, thereby fluidizing the toner base particle and the fine resin particles, and the temperature in a whole powder passage and the temperature of the rotary stirring section are regulated to a given temperature by the temperature regulation section in the temperature regulation step.

According to the invention, the method for manufacturing a toner comprises the temperature regulation step, the fine resin particle adhesion step, the spraying step and the film-forming step, wherein the temperature in the whole powder passage and the temperature of the rotary stirring section are regulated to a given temperature by the temperature regulation section in the temperature regulation step. When the temperature in the whole powder passage and the temperature of the rotary stirring section are regulated, adhesion of the fine resin particles to the toner base particle and film formation proceed smoothly as compared with the case that the temperature of only a part of the powder passage is regulated, and adhesion of the toner base particle and the fine resin particles to an inner wall surface of the powder passage can be further suppressed, and as a result, the inside of the powder passage can be suppressed from being narrowed by the adhesion of the toner base particle and the fine resin particles thereto. Therefore, the toner base particle is uniformly coated with the fine resin particles, and a toner having uniform film state and particle size distribution can be manufactured in a stable manner over a long period of time.

Further, in the invention, it is preferable that an adhesion preventive member having a given thickness in an outward direction of a radius of a peripheral surface of the air pipe is provided at the tip of the air pipe.

According to the invention, the adhesion preventive member having a given thickness in an outward direction of a radius of a peripheral surface of the air pipe is provided at the tip of the air pipe. When the adhesion preventive member is provided, the toner base particle and the fine resin particles do not turn around toward the tip of the liquid pipe for spraying a substance in liquid form and the tip of the air pipe for spraying a carrier gas, and this can prevent the toner base particle and the fine resin particles from adhering to the tips. Therefore, a spraying direction of the substance in liquid form does not change, the amount of a carrier gas sprayed per unit area is constant in the cross-section of the tip of the air pipe, and further stable spraying state can be maintained. As a result, a toner having uniform film state and particle size distribution can be manufactured in a more stable manner over a long period of time.

Further, in the invention, it is preferable that a cross-section of the adhesion preventive member in a direction of axis of the air pipe is trapezoid, and of mutually parallel two sides of the trapezoid, a longer side is in contact with the periphery of the air pipe.

According to the invention, the cross-section of the adhesion preventive member in a direction of axis of the air pipe is trapezoid, and of the mutually parallel two sides of the trapezoid, a longer side is in contact with the periphery of the air pipe. When the adhesion preventive member having the cross-section is provided, even though the toner base particle and the fine resin particles collide with the adhesion preventive members those particles are not blocked by the adhesion preventive member. Therefore, the yield of a toner having uniform film state and particle size distribution can be improved.

Further, in the invention, it is preferable that the substance in liquid form is sprayed by the spraying section after flowing speed of the toner base particle and the fine resin particles is stabilized at the spraying step.

According to the invention, the substance in liquid form is sprayed by the spraying section after the flowing speed of the toner base particle and the fine resin particles is stabilized at the spraying step. This enables to uniformly spray the substance in liquid form to the toner base particle and the fine resin particles, thus making it possible to further improve yield of the toner having uniform film state and particle size distribution.

Further, in the invention, it is preferable that the substance in liquid form sprayed at the spraying step is gasified to have a constant gas concentration in the powder passage.

According to the invention, the substance in liquid form sprayed in the spraying step is gasified to have a constant gas concentration in the powder passage. Whereby, the concentration of the gasified substance in the powder passage is stabilized, thus making it possible to prevent dew condensation due to a sudden rise of the concentration of the gasified substance, aggregation of the toner base particle, and adhesion of the toner base particle and the fine resin particles to the inside of the rotary stirring apparatus. Accordingly, it is possible to further improve yield of the toner having uniform film state and particle size distribution.

Further, in the invention, it is preferable that the gasified substance is exhausted outside the powder passage to have a constant gas concentration in the powder passage.

According to the invention, the gasified substance is exhausted outside the powder passage to have a constant gas concentration in the powder passage. Whereby, the concentration of the gasified substance in the powder passage is kept constant and it is possible to make drying speed of the substance in liquid form higher than a case where the concentration of the gasified substance is not kept constant, thus making it possible to prevent a toner base particle in which an undried substance in liquid form is remained from being adhered to other toner base particles and to further suppress aggregation of the toner base particles. Accordingly, it is possible to further improve yield of the toner having uniform film state and particle size distribution.

Further, in the invention, it is preferable that the substance in liquid form includes at least an alcohol.

According to the invention, the substance in liquid form includes at least an alcohol. In the case where the substance in liquid form includes at least an alcohol, the viscosity of the substance in liquid form is reduced, thus making it possible to perform spraying finely and to spray the substance in liquid form with a uniform droplet diameter without coarsening the diameter of the sprayed droplet of the substance in liquid form to be sprayed by the spraying section. Moreover, it is possible to further promote fining of the droplet diameter at the time of collision of the toner base particles, the fine resin particles and the droplet. This makes it possible to obtain the toner that have excellent uniformity in the coated amount of the fine resin particles. Moreover, the alcohol has a high vapor pressure and therefore is easily removed and dried. Accordingly, it is possible to further improve yield of the toner having uniform film state and particle size distribution.

Further, the invention provides a toner manufactured by the above-mentioned method for manufacturing a toner.

According to the invention, since a toner of the invention is manufactured by the above-mentioned method for manufacturing a toner, the coated amount of the fine resin particles as the coated material is uniform and toner characteristics such as charging characteristics between individual toner particles are uniform. Moreover, the toner of the invention is excellent in durability since an effect of protecting a contained component by the resin layer on the surface of the toner is exhibited. By forming an image using such a toner, it is possible to form an image that has high definition and high image quality without unevenness in density.

Further, the invention provides a developer including the toner mentioned above.

According to the invention, a developer includes the toner mentioned above. This makes it possible that a developer has uniform toner characteristics such as charging characteristics between individual toner particles, thus obtaining a developer capable of maintaining excellent development performance.

Further, in the invention, it is preferable that the developer further comprises a carrier and constitutes a two-component developer.

According to the invention, the developer is a two-component developer including the toner mentioned above and a carrier. Since the toner of the invention has uniform toner characteristics such as charging characteristics between individual toner particles, it is possible to stably form an image that has high definition and high image quality without unevenness in density.

Further, the invention provides a developing device that develops a latent image formed on an image bearing member to form a toner image using the developer mentioned above.

According to the invention, since a latent image is developed using the developer of the invention, it is possible to stably form a toner image that has high definition and high image quality without unevenness in density. Accordingly, it is possible to stably form a high-quality image.

Further, the invention provides an image forming apparatus, comprising:

an image bearing member on which a latent image is to be formed;

a latent image forming section for forming the latent image on the image bearing member; and the developing device mentioned above.

According to the invention, an image forming apparatus is realized by comprising an image bearing member on which a latent image is to be formed; a latent image forming section for forming the latent image on the image bearing member; and the developing device capable of forming the toner image having high definition without unevenness in density as described above. By forming an image by such an image forming apparatus, it is possible to stably form an image that has high definition and high image quality without unevenness in density.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
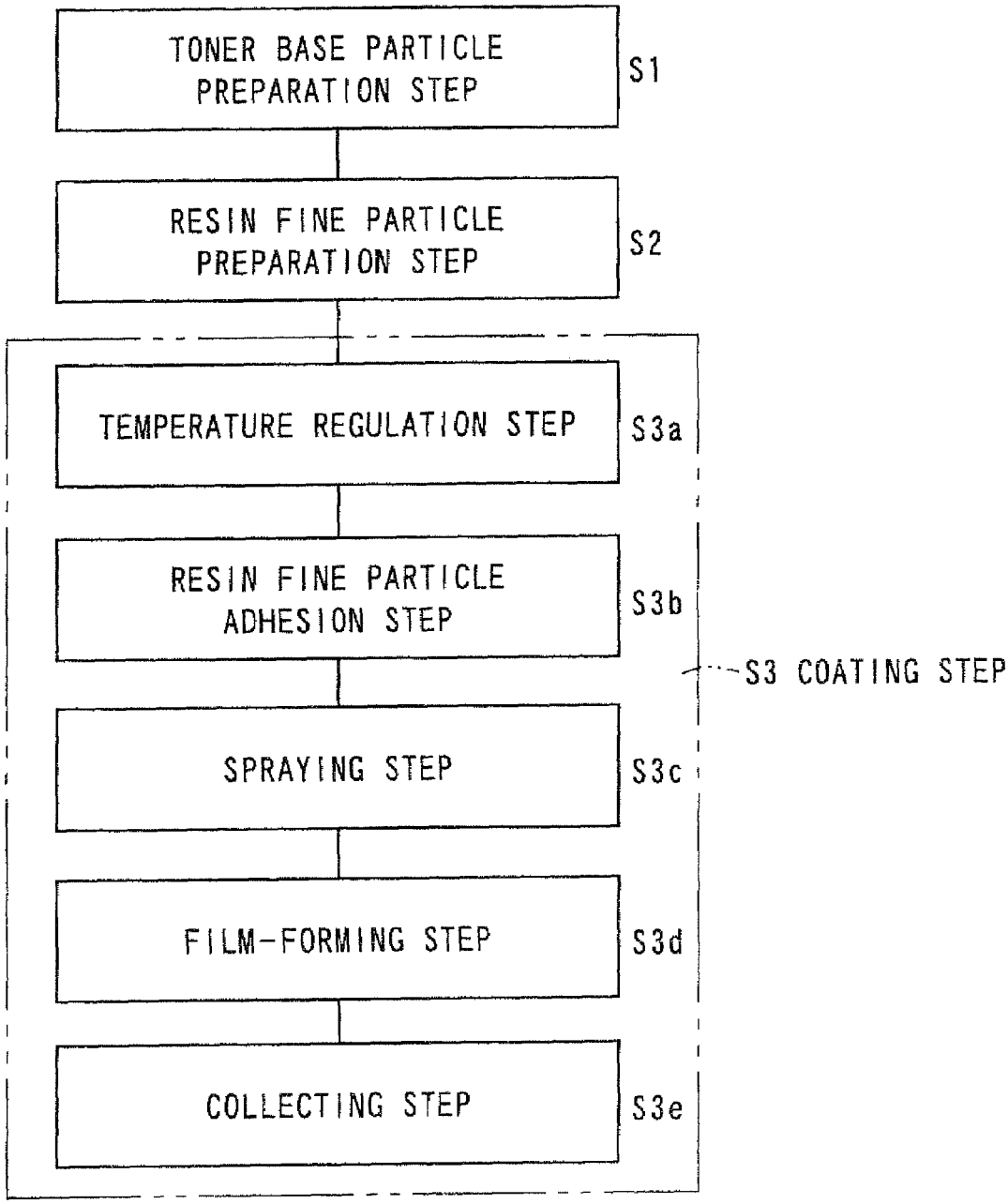
FIG. 1 is a flowchart of an example of a procedure for a method for manufacturing a toner according to a first embodiment of the invention.

Now referring to the drawings, preferred embodiments of the invention are described below.

Method for Manufacturing Toner

The method for manufacturing a toner according to a first embodiment of the invention uses the rotary stirring apparatus. The rotary stirring apparatus comprises a circulation section which repeatedly circulates a toner base particle and fine resin particles in a powder passage comprising a rotary stirring chamber and a circulation pipe by a rotary stirring section comprising a rotary disk having rotating vanes provided on a circumference thereof and a rotary shaft and returns those particles to the rotary stirring chamber; a temperature regulation section which is provided in at least a part of the powder passage and regulates the temperature in the powder passage and the temperature of the rotary stirring section to a given temperature; and a spraying section comprising a two-fluid nozzle which sprays a substance in liquid form for assisting adhesion between the toner base particle and the fine resin particles, and air.

The two-fluid nozzle comprises a liquid pipe and an air pipe, the liquid pipe is inserted in the air pipe such that an axis of the liquid pipe coincides with an axis of the air pipe, and at least a part of the liquid pipe and the air pipe is fixed such that the centers of those pipes do not move. In the method for manufacturing a toner, the substance in liquid form is sprayed in a constant rate from the two-fluid nozzle while regulating the temperature and circulating the toner base particles and the fine resin particles, in the powder passage, and a film is formed on a surface of the toner base particle.

FIG. 1 is a flowchart of an example of a procedure for the method for manufacturing a toner according to the first embodiment of the invention. As shown in FIG. 1, the method for manufacturing a toner of this embodiment includes a toner base particle preparation step S1 of preparing toner base particles, a fine resin particle preparation step S2 of preparing fine resin particles, and a coating step S3 of coating the toner base particle with the fine resin particles.

(1) Toner Base Particle Preparation Step

At the toner base particle preparation step of step S1, toner base particles to be coated with a resin layer are prepared. The toner base particles are particles each containing a binder resin and a colorant and can be obtained with a known method without particular limitation to a preparation method thereof. Examples of the method for preparing toner base particles include dry methods such as pulverization methods, and wet methods such as suspension polymerization methods, emulsion aggregation methods, dispersion polymerization methods, dissolution suspension methods and melting emulsion methods. The method for preparing toner base particles using a pulverization method will be described below.

(Method for Preparing Toner Base Particles by a Pulverization Method)

In a method for preparing toner base particles using a pulverization method, a toner composition containing a binder resin, a colorant and other additives is dry-mixed by a mixer, and thereafter melt-kneaded by a kneading machine. The kneaded material obtained by melt-kneading is cooled and solidified, and then the solidified material is pulverized by a pulverizing machine. Subsequently, the toner base particles are optionally obtained by conducting adjustment of a particle size such as classification.

Usable mixers include heretofore known mixers including, for example, Henschel-type mixing devices such as HENSCHEL MIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 and PCM-30, both of which are trade names and manufactured by Ikegai, Ltd., and open roll-type kneading machines such as KNEADEX (trade name) manufactured by Mitsui Mining Co., Ltd. Among them, the open roll-type kneading machines are preferable.

Examples of the pulverizing machine include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner base particles by classification with a centrifugal force or classification with a wind force is usable and an example thereof includes a revolving type wind-force classifying machine (rotary type wind-force classifying machine).

(Raw Materials of Toner Base Particles)

As described above, the toner base particles each contain the binder resin and the colorant. The binder resin is not particularly limited and any known binder resin used for a black toner or a color toner is usable, and examples thereof include a styrene resin such as a polystyrene and a styrene-acrylic acid ester copolymer resin, an acrylic resin such as a polymethylmethacrylate, a polyolefin resin such as a polyethylene, a polyester, a polyurethane, and an epoxy resin. Further, a resin obtained by polymerization reaction induced by mixing a monomer mixture material and a release agent may be used. The binder resin may be used each alone, or two or more of them may be used in combination.

Among the binder resins, polyester is preferable as binder resin for color toner owing to its excellent transparency as well as good powder flowability, low-temperature fixing property, and secondary color reproducibility. For polyester, heretofore known substances may be used including a polycondensation of polybasic acid and polyvalent alcohol.

For polybasic acid, substances known as monomers for polyester can be used including, for example: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and methyl-esterified compounds of these polybasic acids. The polybasic acids may be used each alone, or two or more of them may be used in combination.

For polyvalent alcohol, substances known as monomers for polyester can also be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more of them may be used in combination.

The polybasic acid and the polyvalent alcohol can undergo polycondensation reaction in an ordinary manner, that is, for example, the polybasic acid and the polyvalent alcohol are brought into contact with each other in the presence or absence of the organic solvent using the polycondensation catalyst. The polycondensation reaction ends when an acid number, a softening temperature, etc. of the polyester to be produced reach predetermined values. The polyester is thus obtained. When the methyl-esterified compound of the polybasic acid is used as part of the polybasic acid, demethanol polycondensation reaction is caused. In the polycondensation reaction, a compounding ratio, a reaction rate, etc. of the polybasic acid and the polyvalent alcohol are appropriately modified, thereby being capable of, for example, adjusting a content of a carboxyl end group in the polyester and thus allowing for denaturation of the polyester. The denatured polyester can be obtained also by simply introducing a carboxyl group to a main chain of the polyester with use of trimellitic anhydride as polybasic acid. Note that polyester self-dispersible having self-dispersibility in water may also be used which polyester has at least one of a main chain and side chain bonded to a hydrophilic radical such as a carboxyl group or a sulfonate group. Further, polyester may be grafted with acrylic resin.

It is preferred that the binder resin have a glass transition temperature of 30° C. or higher and 80° C. or lower. The binder resin having a glass transition temperature lower than 30° C. easily causes the blocking that the toner thermally aggregates inside the image forming apparatus, which may decrease preservation stability. The binder resin having a glass transition temperature higher than 80° C. lowers the fixing property of the toner onto a recording medium, which may cause a fixing failure.

As the colorant, it is possible to use an organic dye, an organic pigment, an inorganic dye, an inorganic pigment or the like which is customarily used in the electrophotographic field.

Examples of black colorant include carbon black, copper oxide, manganese dioxide, aniline black, activated carbon, non-magnetic ferrite, magnetic ferrite, and magnetite.

Examples of yellow colorant include yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, C.I. pigment yellow 138, C.I. pigment yellow 180, and C.I. pigment yellow 185.

Examples of orange colorant include red chrome yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Examples of red colorant include red iron oxide, cadmium red, red lead, mercury sulfide, cadmium, permanent red 4R, lysol red, pyrazolone red, watching red, calcium salt, lake red C, lake red X, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Examples of purple colorant include manganese purple, fast violet B, and methyl violet lake.

Examples of blue colorant include Prussian blue, cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Examples of green colorant include chromium green, chromium oxide, pigment green B, malachite green lake, final yellow green G, and C.I. pigment green 7.

Examples of white colorant include those compounds such as zinc oxide, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 5 parts by weight to 20 parts by weight, and more preferably 5 parts by weight to 10 parts by weight based on 100 parts by weight of the binder resin.

The colorant may be used as a masterbatch to be dispersed uniformly in the binder resin. Further, two or more kinds of the colorants may be formed into a composite particle. The composite particle is capable of being manufactured, for example, by adding an appropriate amount of water, lower alcohol and the like to two or more kinds of colorants and granulating the mixture by a general granulating machine such as a high-speed mill, followed by drying. The masterbatch and the composite particle are mixed into the toner composition at the time of dry-mixing.

The toner base particles may contain a charge control agent in addition to the binder resin and the colorant. For the charge control agent, charge control agents commonly used in this field for controlling a positive charge and a negative charge are usable.

Examples of the charge control agent for controlling a positive charge include a basic dye, a quaternary ammonium salt, a quaternary phosphonium salt, an aminopyrine, a pyrimidine compound, a polynuclear polyamino compound, an aminosilane, a nigrosine dye, a derivative thereof, a triphenylmethane derivative, a guanidine salt and an amidin salt.

Examples of the charge control agent for controlling a negative charge include an oil-soluble dye such as an oil black and a spirone black, a metal-containing azo compound, an azo complex dye, a naphthene acid metal salt, a metal complex or metal salt (the metal is a chrome, a zinc, a zirconium or the like) of a salicylic acid or of a derivative thereof, a boron compound, a fatty acid soap, a long-chain alkylcarboxylic acid salt and a resin acid soap. The charge control agents may be used each alone, or optionally two or more of them may be used in combination. Although the amount of the charge control agent to be used is not particularly limited and can be properly selected from a wide range, 0.5 parts by weight or more and 3 parts by weight or less is preferably used based on 100 parts by weight of the binder resin.

Further, the toner base particles may contain a release agent in addition to the binder resin and the colorant. As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax.

A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

The toner base particles obtained at the toner base particle preparation step S1 preferably have a volume average particle size of 4 μm or more and 8 μm or less. In a case where the volume average particle size of the toner base particles is 4 μm or more and 8 μm or less, it is possible to stably form a high-definition image for a long time. Moreover, by reducing the particle size to this range, a high image density is obtained even with a small amount of adhesion, which generates an effect capable of reducing an amount of toner consumption. In a case where the volume average particle size of the toner base particles is less than 4 μm, the particle size of the toner base particles becomes too small and high charging and low fluidity are likely to occur. When the high charging and the low fluidity occur, a toner is unable to be stably supplied to a photoreceptor and a background fog and image density decrease are likely to occur. In a case where the volume average particle size of the toner base particles exceeds 8 μm, the particle size of the toner base particles becomes large and the layer thickness of a formed image is increased so that an image with remarkable granularity is generated and the high-definition image is not obtainable, which is undesirable. In addition, as the particle size of the toner base particles is increased, a specific surface area is reduced, resulting in decrease in a charge amount of the toner. When the charge amount of the toner is reduced, the toner is not stably supplied to the photoreceptor and pollution inside the apparatus due to toner scattering is likely to occur.

(2) Fine Resin Particle Preparation Step

In the fine resin particle preparation step of step S2, dried fine resin particles are prepared. The fine resin particles are used as a material for forming a film on the surface of the toner base particles in the subsequent coating step S3. By using the fine resin particles as a material for forming a film on the surface of the toner base particles, occurrence of aggregation due to melting of a low melting component such as a release agent contained in the toner base particles can be prevented during storage. Furthermore, by regulating a film state when coating the toner base particles, the shape of the toner base particles remains in a toner obtained, and a film can be formed while remaining uneven shape of the fine resin particles on the surface of the toner base particles. Therefore, a toner having excellent cleaning properties as compared with a toner having s smooth surface can be obtained.

The fine resin particles can be obtained, for examples by polymerizing monomers or emulsifying and dispersing raw materials of the fine resin particles into fine grains by using a homogenizer or the like machine. Any method may be used for drying of resin particle obtained in such a manner, and it is possible to obtain the dried fine resin particles by using methods such as drying of a hot air receiving type, drying of heat transfer by heat conduction type, far infrared radiation drying, and microwave drying.

For the resin used for raw materials of the fine resin particles, a resin used for materials of a toner is usable and examples thereof include a polyester, an acrylic resin, a styrene resin, and a styrene-acrylic copolymer. Among the resins exemplified above, the fine resin particles preferably contain an acrylic resin and a styrene-acrylic copolymer. The acrylic resin and the styrene-acrylic copolymer have many advantages such that the strength is high with light weight, transparency is high, the price is low, and materials having a uniform particle size are easily obtained.

Although the resin used for raw materials of the fine resin particles may be the same kind of resin as the binder resin contained in the toner base particles or may be a different kind of resin, the different kind of resin is preferably used in view of performing the surface modification of the toner. When the different kind of resin is used as the resin used for the raw materials of the fine resin particles, a softening temperature of the resin used for the raw materials of the fine resin particles is preferably higher than a softening temperature of the binder resin contained in the toner base particles. This makes it possible to prevent toners manufactured with the manufacturing method of this embodiment from being fused each other during storage and to improve storage stability. Further, the softening temperature of the resin used for the raw materials of the fine resin particles depends on an image forming apparatus in which the toner is used, but is preferably 80° C. or more and 140° C. or less. By using the resin in such a temperature range, it is possible to obtain the toner having both the storage stability and the fixing performance.

The fine resin particles are required to have a volume average particle size sufficiently smaller than an average particle size of the toner base particles. The volume average particle size of the fine resin particles is preferably 0.05 μm or more and 1 μm or less, and more preferably 0.1 μm or more and 0.5 μm or less. When the volume average particle size of the fine resin particles is 0.05 μm or more and 1 μm or less, the fine resin particles are easily adhered to the surface of the toner base particles, and fine resin particles which are easily softened and are easily film-formed can be obtained.

(3) Coating Step

<Rotary Stirring Apparatus>

Figure 2:
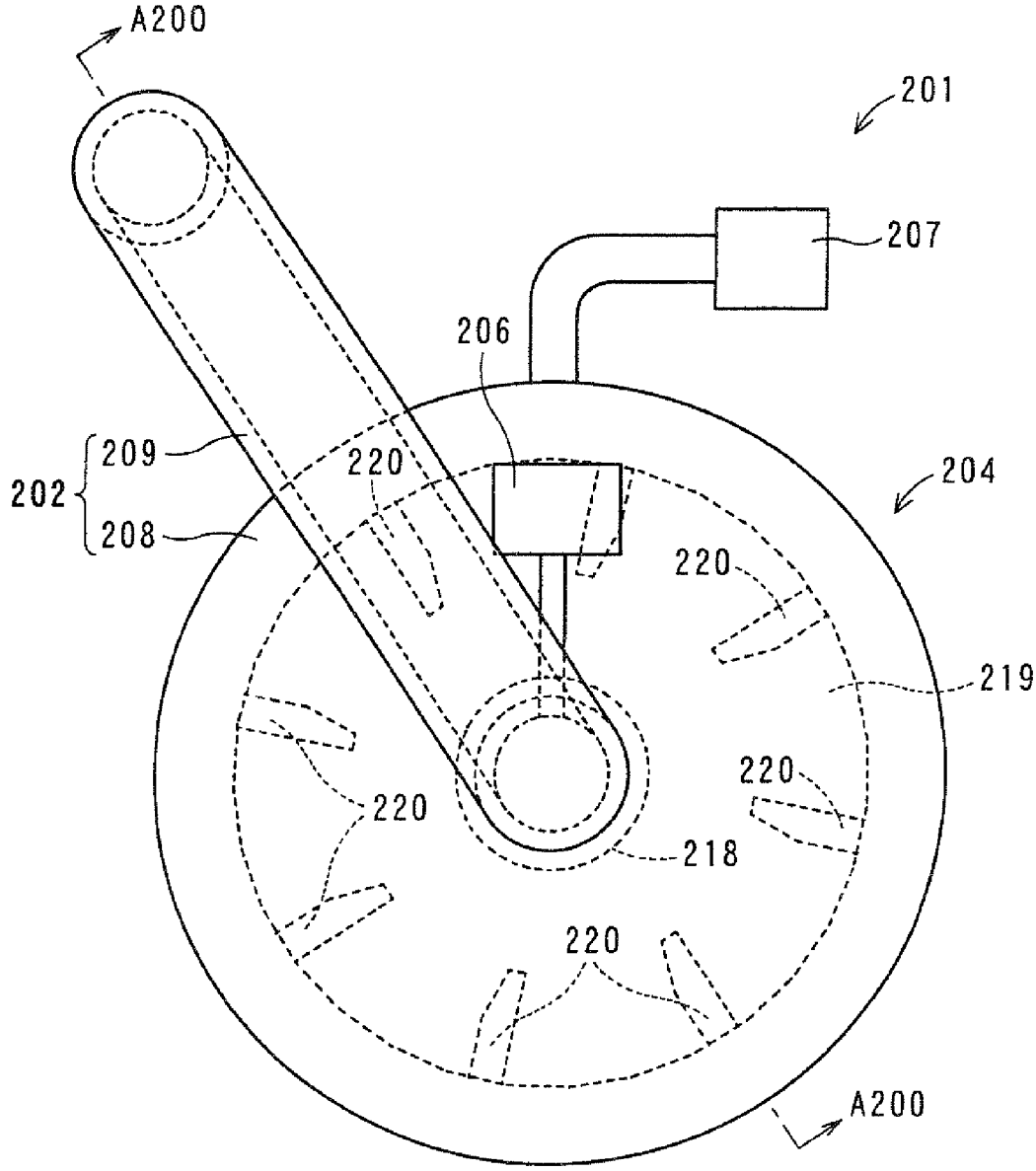
FIG. 2 is a front view of a configuration of a rotary stirring apparatus.
Figure 3:
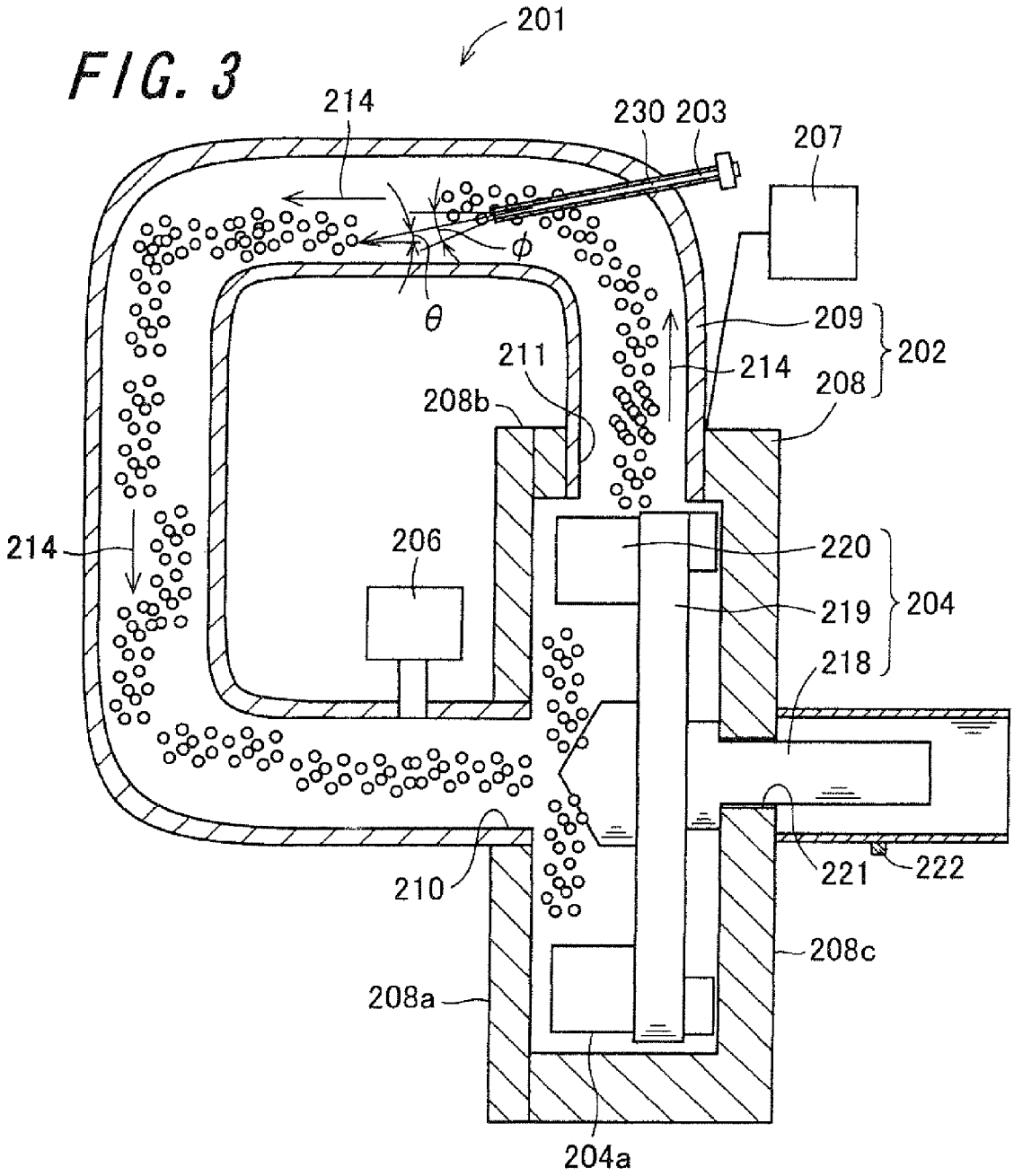
FIG. 3 is a schematic sectional view of the rotary stirring apparatus shown in FIG. 2 taken along the cross-sectional line A200-A200.

At the coating step of step S3, a rotary stirring providing at least a circulation section, a temperature regulation section and a spraying section is used. FIG. 2 is a front view of a configuration of a rotary stirring apparatus 201 used for the method for manufacturing a toner which is a first embodiment of the invention. FIG. 3 is a schematic sectional view of the rotary stirring apparatus 201 shown in FIG. 2 taken along the cross-sectional line A200-A200. At the coating step of step S3, for example, using the toner manufacturing apparatus 201 shown in FIG. 2, the fine resin particles prepared at the fine resin particle preparation step of step S2 are adhered to the toner base particle prepared at the toner base particle preparation step of step S1 to form a resin film on the surface of toner base particle by a multiplier effect of circulation by a circulation section, an impact force of stirring in the apparatus and regulating temperatures by a temperature regulation section.

The circulation section 201 which is a toner manufacturing apparatus is comprised of a powder passage 202, a spraying section 203, a rotary stirring section 204, a temperature regulation jacket (not shown), a powder inputting section 206, and a powder collecting section 207. The rotary stirring section 204 and the powder passage 202 constitute a circulation section.

(Powder Passage)

The powder passage 202 is comprised of a stirring section 208 and a powder flowing section 209. The stirring section 208 is a cylindrical container-like member having an internal space. Opening sections 210 and 211 are formed in the stirring section 208 which is a rotary stirring chamber. The opening section 210 is formed at an approximate center part of a surface 208*a* in one side of the axial direction of the stirring section 208 so as to penetrate a side wall including the surface 208*a* of the stirring section 208 in the thickness direction. Moreover, the opening section 211 is formed at a side surface 208*b* perpendicular to the surface 208*a* in one side of the axial direction of the stirring section 208 so as to penetrate a side wall including the side surface 208*b* of the stirring section 208 in the thickness direction. The powder flowing section 209 which is a circulation tube has one end connected to the opening section 210 and the other end connected to the opening section 211. Whereby, the internal space of the stirring section 208 and the internal space of the powder flowing section 209 are communicated to form the powder passage 202. The toner base particles, the fine resin particles and gas flow through the powder passage 202. The powder passage 202 is provided so that a powder flowing direction which is a direction in which the toner base particles and the fine resin particles flow is constant.

(Rotary Stirring Section)

The rotary stirring section 204 includes a rotary shaft member 218, a discotic rotary disc 219, and a plurality of stirring blades 220. The rotary shaft member 218 is a cylindrical-bar-shaped member that has an axis matching an axis of the stirring section 208, that is provided so as to be inserted in a through-hole 221 formed at the surface 208*c* in the other side of the axial direction of the stirring section 208 to penetrate the side wall including the surface 208*c* in the thickness direction, and that is rotated around the axis by a motor (not shown). The rotary disc 219 is a discotic member having the axis supported by the rotary shaft member 218 so as to match the axis of the rotary shaft member 218 and rotating with rotation of the rotary shaft member 218. The plurality of stirring blades 220 are supported by the peripheral edge of the rotary disc 219 and are rotated with rotation of the rotary disc 219.

The rotary shaft member 218 is rotatable at peripheral speed of 50 m/sec or more in an outermost peripheral. The outermost peripheral is a part of the rotary stirring section 204 that has the longest distance from the rotary shaft member 218 in the direction perpendicular to the rotary shaft member 218.

(Spraying Section)

The spraying section 203 is provided in a powder flowing section nearest the opening 211 in a fluidizing direction of the toner base particles and the fine resin particles in the powder flowing section 209 of the powder passage 202. The spraying section 203 comprises a liquid storage part (not shown) which stores a substance in liquid form, a carrier gas feed part (not shown) which feeds a carrier gas, and a two-fluid nozzle 230 which ejects a substance in liquid form for assisting adhesion between the toner base particles and the fine resin particles, and a carrier gas toward the toner base particles and the fine resin particles present in the powder passage 202, thereby spraying droplets of the substance in liquid form to the toner base particles and the fine resin particles.

Figure 4:
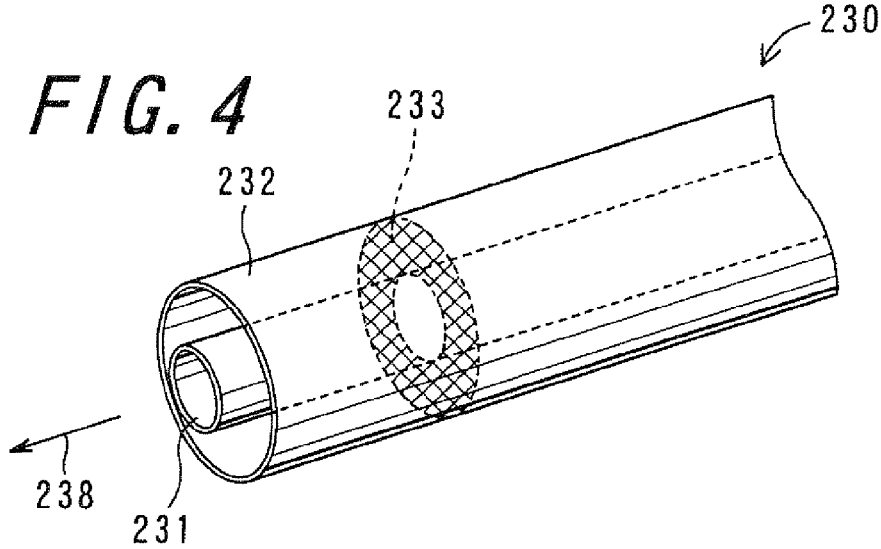
FIG. 4 is a plan view schematically showing the structure of a two-fluid nozzle.

FIG. 4 is a plan view schematically showing the structure of the two-fluid nozzle 230. In the embodiment, the two-fluid nozzle 230 comprises a liquid pipe 231 and an air pipe 232, and the liquid pipe 231 is inserted in the air pipe 232 such that the axis of the liquid pipe 231 coincides with the axis of the air pipe 232. A fixing member 233 for fixing the air pipe 232 and the liquid pipe 231 is provided in the air pipe 232. Thus, by fixing at least a part of the liquid pipe 232 and the air pipe 231, a structure that the centers of those pipes do not move is obtained. The fixing member for fixing at least a part of the liquid pipe 231 and the air pipe 232 is not particularly limited so long as flow of a carrier gas is not prevented and the centers of the liquid pipe 231 and the air pipe 232 can be prevented from being moved. The embodiment uses a mesh material. Furthermore, the fixing member is not limited to a structure that an inner wall of the air pipe and an outer wall of the liquid pipe are fixed with the fixing member. The air pipe 232 and the liquid pipe 231 may separately be fixed. The substance in liquid form and the carrier gas are sprayed in a direction of the arrow 238.

The inner diameter of the liquid pipe 231 of the two-fluid nozzle 230 is preferably 0.5 mm or more and 2.0 mm or less. The inner diameter of the air pipe 232 is preferably 1.0 mm or more and 5.0 mm or less. Ratio of the inner diameter of the air pipe 232 to the inner diameter of the liquid pipe 231 is preferably 1:3. The more the ratio of the inner diameter of the air pipe 232 to the inner diameter of the liquid pipe 231 is away from the range, spraying state of the substance in liquid form becomes worse and aggregate is easily generated. The fixing member provided in the air pipe 232 is preferably arranged at the position near the tip of the air pipe 232. A material of the two-fluid nozzle 230 is not particularly limited, and any material that can be processed by molding or processed by cutting as a nozzle can be used. Examples of the material include various irons and steels such as iron, carbon steel and stainless steel; non-ferrous metals such as copper, aluminum, titanium and nickel; ceramics; plastics, glass fibers; carbon fibers; and reinforced (composite) plastic materials reinforced with metal fibers or the like. Of those, stainless steel is particularly preferred.

Figure 5:
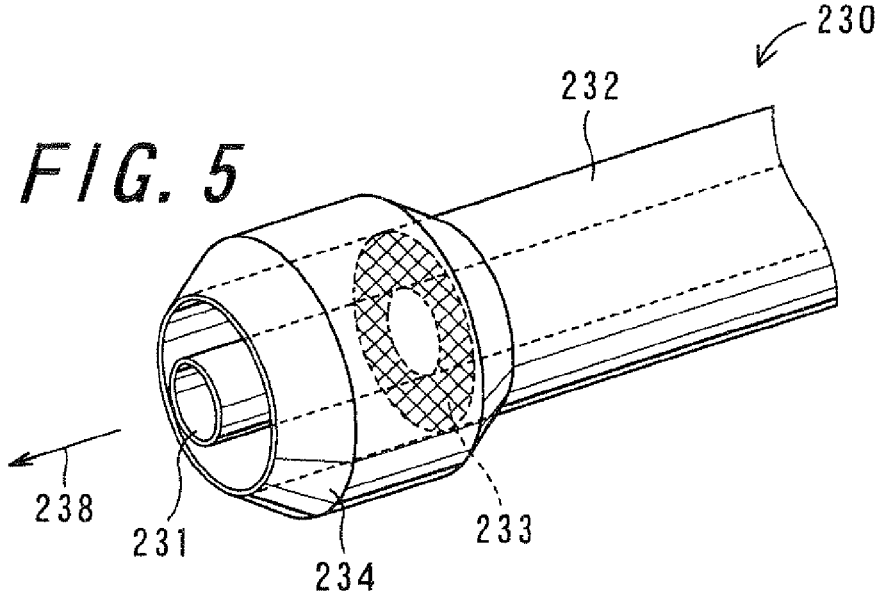
FIG. 5 is a plan view schematically showing the structure of the two-fluid nozzle having an adhesion preventive member provided thereon.
Figure 6:
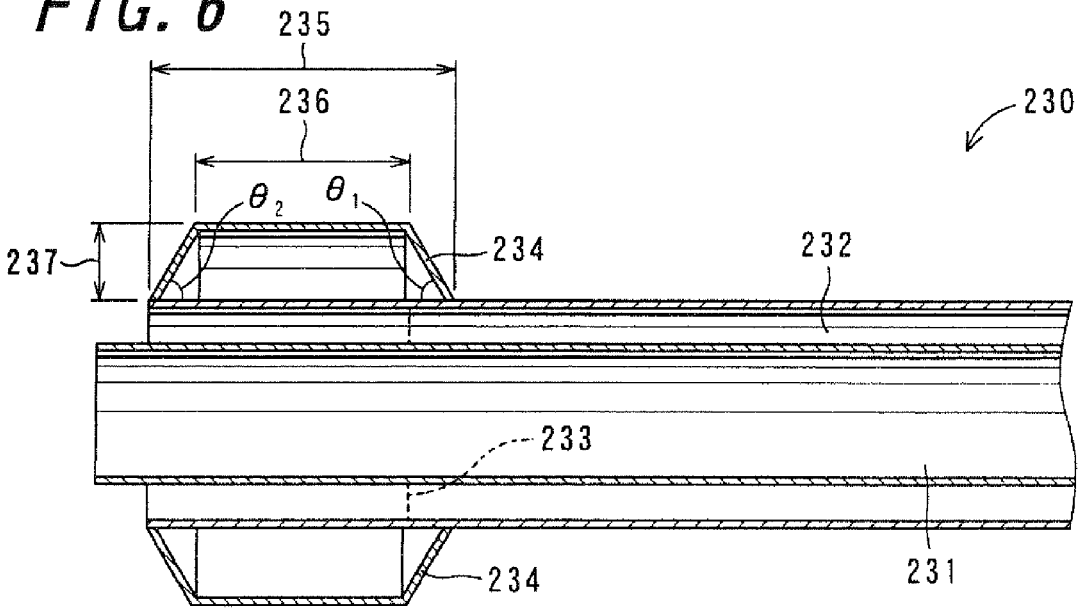
FIG. 6 is a cross-sectional view schematically showing the structure of the two-fluid nozzle having the adhesion preventive member provided thereon.

An adhesion preventive member 234 having a given thickness in an outward direction of a radius of the periphery of the air pipe 232 is preferably provided in the tip of the air pipe 232. FIG. 5 is a plan view schematically showing the structure of the two-fluid nozzle 230 having the adhesion preventive member 234 provided thereon. FIG. 6 is a cross-sectional view schematically showing the structure of the two-fluid nozzle 230 having the adhesion preventive member 234 provided thereon. The arrangement of the adhesion preventive member 234 can prevent the toner base particles and the fine resin particles turning around toward the tip of the liquid pipe 231 for spraying a substance in liquid form and the tip of the air pipe 232 for spraying a carrier gas from adhering to the tips. Therefore, a spraying direction of the substance in liquid form does not change, the amount of a carrier gas sprayed per unit area is constant in the cross-section of the tip of the air pipe 232, and further stable spraying state can be maintained. As a result, a toner having uniform film state and particle size distribution can be manufactured in a stable manner over a long period of time.

As shown in FIG. 6, the cross-section of the adhesion preventive member 234 in a direction of axis of the air pipe 232 is trapezoid, and of the mutually parallel two sides of the trapezoid, a longer side 235 is preferably in contact with the periphery of the air pipe 232. By providing the adhesion preventive member 234 having the cross-section, even though the toner base particles and the fine resin particles collide with the adhesion preventive member 234, those particles are not blocked by the adhesion preventive member 234. Therefore, the yield of a toner having uniform film state and particle size distribution can be improved.

In FIG. 6, angles $\theta_1$ and $\theta_2$ between two sides other than the mutually parallel two sides 235 and 236 and the longer side 235 in the mutually parallel two sides are 10° or more and 60° or less, respectively. Where the angle of $\theta_1$ and $\theta_2$ is too small, the effect that can prevent the toner base particles and the fine resin particles turning around toward the tip of the liquid pipe 231 and the tip of the air pipe 232 from adhering to the tips is not sufficiently exhibited. Where the angle of $\theta_1$ and $\theta_2$ is too large, the toner base particles and the fine resin particles are easily blocked by the adhesion preventive member 234.

Length of the sides 235 and 236 and height 237 of the trapezoid in the cross-section of the adhesion preventive member 234 vary depending on a size of the two-fluid nozzle 230 used by a scale of the rotary stirring apparatus 201, that is, length and inner diameter of the liquid pipe 231 and the air pipe 232. Therefore, it is preferred that those are appropriately adjusted according to a size of the two-fluid nozzle 230 used.

[Temperature Regulation Jacket]

Returning to FIG. 2 and FIG. 3, a temperature regulation jacket (not shown) as a temperature regulation section is provided in at least a part of the outside of the powder passage 202. Cooling medium or heating medium is passed through a space inside the jacket, and the temperature in the powder passage 202 and the temperature of the rotary stirring section 204 are regulated to a given temperature. By this regulation, the temperature in the powder passage and the temperature of the outside of the rotary stirring section can be controlled to a temperature lower than the temperature at which the toner base particles and the fine resin particles introduced in the fine resin particle adhesion step S3*b* do not get soft or deform. In a spraying step S3*c* and a film forming step S3*d* described hereinafter, variation in temperature applied to the toner base particles, the fine resin particles and the substance in liquid form is decreased, and this makes it possible to maintain the toner base particles and the fine resin particles in a stable fluidized state.

The toner base particles and the fine resin particles, comprising a synthetic resin or the like generally collide with the inner wall of the powder passage many times. At the collision, a part of collision energy is converted into heat energy, and the heat energy is stored in the toner base particles and the fine resin particles. With increasing the number of collision, the heat energy stored in those particles is increased, and then the toner base particles and the fine resin particles get soft and adhere to the inner wail of the powder passage. However, by passing a cooling medium or a heating medium through the space in the jacket to regulate the temperature as described before, adhesion force of the toner base particles and the fine resin particles to the inner wall of the powder passage is reduced. As a result, adhesion of the toner base particles to the inner wall of the powder passage 202 due to rapid increase in temperature in the apparatus can surely be prevented, and the powder passage can be suppressed form being narrowed by the toner base particles and the fine resin particles. Accordingly, the toner base particles are uniformly coated with the fine resin particles, and a toner coated with a resin layer can be manufactured in high yield.

In the inside of the powder flowing section 209 downstream of the spraying section 203, the substance in liquid form sprayed is not dried and remains therein. Where the temperature is not appropriate, drying rate becomes slow, and the substance in liquid form easily remains. Where the toner base particles are in contact with the residual liquid, the toner base particles are easily adhered to the inner wall of the powder passage 202. This may be the generation source of aggregation of the toner base particles. On the inner wall in the vicinity of the opening 210, the toner base particles flowing into the stirring section 208 from the opening 210 by passing through the powder flowing section 209 easily collide with the toner base particles fluidized in the stirring section 208 by the stirring with the rotary stirring section 204. By this, the toner base particles collided are easily adhered to the vicinity of the opening 210. Therefore, adhesion of the toner base particles to the inner wall of the powder passage 202 can further securely be prevented by providing the temperature regulation jacket in an area to which the toner base particles are easily adhered.

(Powder Inputting Section and Powder Collecting Section)

Figure 7:
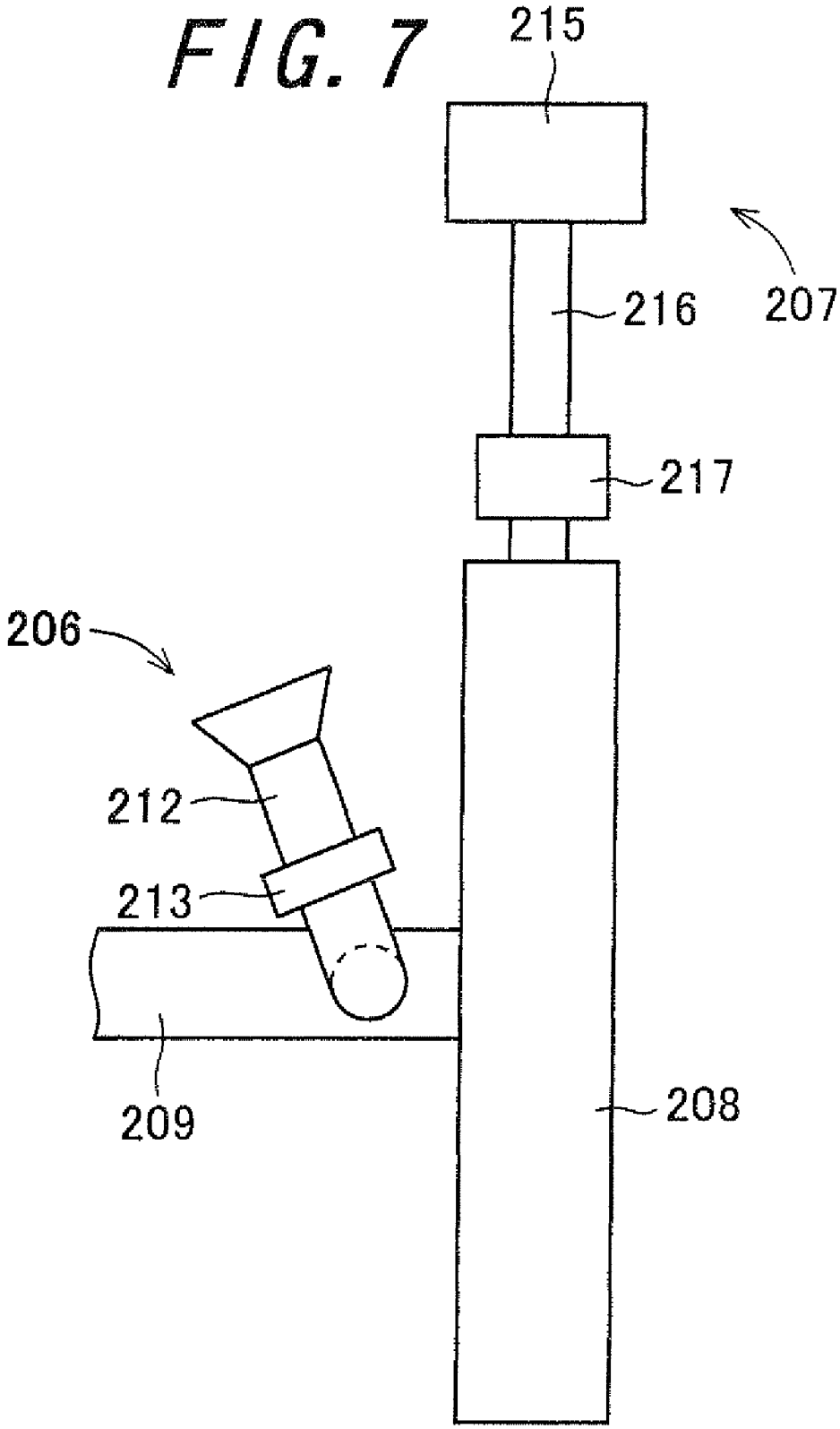
FIG. 7 is a front view of a configuration around the powder inputting section and the powder collecting section.

The powder flowing section 209 of the powder passage 202 is connected to the powder inputting section 206 and the powder collecting section 207. FIG. 7 is a front view of a configuration around the powder inputting section 206 and the powder collecting section 207. The powder inputting section 206 includes a hopper (not shown) that supplies the toner base particles and the fine resin particles, a supplying tube 212 that communicates the hopper and the powder passage 202, and an electromagnetic valve 213 provided in the supplying tube 212. The toner base particles and the fine resin particles supplied from the hopper are supplied to the powder passage 202 through the supplying tube 212 in a state where the passage in the supplying tube 212 is opened by the electromagnetic valve 213. The toner base particles and the fine resin particles supplied to the powder passage 202 flow in the constant powder flowing direction with stirring by the rotary stirring section 204. Moreover, the toner base particles and the fine resin particles are not supplied to the powder passage 202 in a state where the passage in the supplying tube 212 is closed by the electromagnetic valve 213.

The powder collecting section 207 includes a collecting tank 215, a collecting tube 216 that communicates the collecting tank 215 and the powder passage 202, and an electromagnetic valve 217 provided in the collecting tube 216. The toner particles flowing through the powder passage 202 are collected in the collecting tank 215 through the collecting tube 216 in a state where the passage in the collecting tube 216 is opened by the electromagnetic valve 217. Moreover, the toner particles flowing through the powder passage 202 are not collected in a state where the passage in the collecting tube 216 is closed by the electromagnetic valve 217.

The coating step S3 using the toner manufacturing apparatus 1 as described above includes a temperature regulation step S3*a*, a fine resin particle adhering step S3*b*, a spraying step S3*c*, a film-forming step S3*d*, and a collecting step S3*e*.

(3)-1 Temperature Regulation Step S3*a*

At the temperature regulation step of step S3*a*, while the rotary stirring section 204 is rotated, temperatures in the powder passage 202 and of the rotary stirring section 204 are regulated to a predetermined temperature by passing a medium through the temperature regulation jacket disposed on the outside thereof. This makes it possible to control the temperature in the powder passage 202 at a temperature or less at which the toner base particles and the fine resin particles that are input at the fine resin particle adhering step S3*b* described below are not softened and deformed.

In the step, not only a part of the powder passage 202 but the whole of the powder passage 202 and the rotary stirring section 204 are preferably temperature-regulated. By this temperature regulation, as compared with the case that only a part of the powder passage is temperature-regulated, adhesion of the fine resin particles to the toner base particles and film formation proceed smoothly, and adhesion of the toner base particles and the fine resin particles to the wall surface of the powder passage can further be suppressed. As a result, the inside of the powder passage can be suppressed from being narrowed by the adhesion of the toner base particles and the fine resin particles thereto. Accordingly, the toner base particles are uniformly coated with the fine resin particles, and a toner having uniform film state and particle size distribution can be manufactured in a more stable manner over a long period of time.

(3)-2 Fine Resin Particle Adhering Step S3*b*

At the fine resin particle adhering step of step S3*b*, the toner base particles and the fine resin particles are supplied from the powder inputting section 206 to the powder passage 202 in a state where the rotary shaft member 218 of the rotary stirring section 204 is rotated. The toner base particles and the fine resin particles supplied to the powder passage 202 are stirred by the rotary stirring section 204 to flow through the powder flowing section 209 of the powder passage 202 in the direction indicated by an arrow 214. Whereby, the fine resin particles are adhered to the surface of the toner base particles.

(3)-3 Spraying Step S3*c*

At the spraying step of step S3*c*, a liquid having an effect of assisting adhesion between the toner base particle and the fine resin particles in a fluidized state and plasticizing the particles without dissolving those particles, is sprayed from the spraying section 203 by carrier gas. The substance in liquid form is fed to the spraying section 203 by a liquid feeding pump with a constant flow amount and the substance in liquid form sprayed by the spraying section 203 is gasified so that the gasified substance is spread on the surface of the toner base particles and the fine resin particles. Whereby, the toner base particles and the fine resin particles are plasticized.

(Spray Liquid)

The substance in liquid form having an effect of assisting adhesion between the toner base particles and the fine resin particles and plasticizing the toner base particles and the fine resin particles without dissolving those particles, is not particularly limited, but is preferably a substance in liquid form that is easily vaporized since the substance in liquid form needs to be removed from the toner base particles and the fine resin particles after the substance in liquid form is sprayed. An example of the substance in liquid form includes a substance in liquid form including lower alcohol. Examples of the lower alcohol include methanol, ethanol, and propanol. In a case where the substance in liquid form includes such lower alcohol, it is possible to enhance wettability of the fine resin particles as a coating material with respect to the toner base particle and adhesion, deformation and film-forming of the fine resin particles are easily performed over the entire surface or a large part of the toner base particles. Further, since the lower alcohol has a high vapor pressure, it is possible to further shorten the drying time at the time of removing the substance in liquid form and to suppress aggregation of the toner base particles.

Further, the viscosity of the substance in liquid form is preferably 5 cP or less. A preferable example of the substance in liquid form having the viscosity of 5 cP or less includes alcohol. Examples of the alcohol include methyl alcohol and ethyl alcohol. These alcohols have the low viscosity and are easily vaporized, and therefore, when the substance in liquid form includes the alcohol, it is possible to spray the substance in liquid form with a minute droplet diameter without coarsening a diameter of the spray droplet of the substance in liquid form to be sprayed from the spraying section 203. It is also possible to spray the substance in liquid form with a uniform droplet diameter. It is possible to further promote fining of the droplet at the time of collision of the toner base particles and the droplet. This makes it possible to obtain a resin layer-coated toner having excellent uniformity by uniformly wetting the surfaces of the toner base particle and the fine resin particles and applying the toner base particle and the fine resin particles and softening the fine resin particles by a multiplier effect with collision energy.

The viscosity of the substance in liquid form is measured at 25° C. The viscosity of the substance in liquid form can be measured, for example, by a cone/plate type rotation viscometer.

The substance in liquid form is preferably sprayed such that concentration of the gasified substance measured by a concentration sensor in a gas exhaust part 222 is 3% or less. To realize such concentration of the substance in the form of liquid, spraying rate of the substance in liquid form is appropriately changed according to characteristics and amount of the toner base particles and the fine resin particles, and scale of the rotary stirring apparatus 201.

(Carrier Gas)

Compressed air can be used as a carrier gas. Preferred flow rate of the carrier gas depends on spraying rate of the substance in liquid form which varies by the scale of the rotary stirring apparatus 201 and the amounts of the toner base particles and the fine resin particles. Therefore, the flow rate of the carrier gas is appropriately regulated in conformity with the spraying rate of the substance in liquid form.

In the step, spraying of the substance in liquid form from the spraying section 203 is preferably initiated after the surface of the toner base particles and fluidizing rate of the fine resin particles are stabilized in the powder passage 202. This can uniformly spray the substance in liquid form to the toner base particles and the fine resin particles. As a result, the yield of a toner having uniform film state and particle size distribution can be improved.

An angle θ formed by a liquid spraying direction which is a direction of the axis of the two-fluid nozzle and the powder flowing direction which is a direction in which the toner base particles and the fine resin particles flow in the powder passage 202 is preferably 0° or more and 45° or less. In a case where the angle θ falls within this range, the droplet of the substance in liquid form is prevented from recoiling from the inner wall of the powder passage 202 and yield of the toner base particles coated with the resin film is able to be further improved. In a case where the angle θ formed by the liquid spraying direction from the spraying section 203 and the powder flowing direction exceeds 45°, the droplet of the substance in liquid form easily recoils from the inner wall of the powder passage 202 and the substance in liquid form is easily retained, thus generating aggregation of the toner particles and deteriorating the yield. The two-fluid nozzle is provided so as to be inserted in the opening formed on the outer wall of the powder passage 202.

Further, a spreading angle ϕ of the substance in liquid form sprayed by the two-fluid nozzle is preferably 20° or more and 90° or less. In a case where the spreading angle ϕ falls out of this range, it is likely to be difficult to spray the substance in liquid form uniformly to the toner base particles.

(3)-4 Film-Forming Step

At the film-forming step of step S3*d*, with a multiplier effect of regulating temperatures by a temperature regulation section, circulation by the toner manufacturing apparatus 201 and an impact force by stirring as well as thermal energy by stirring while spraying the substance in liquid form, the fine resin particles are softened to form a consecutive film and stirring of the rotary stirring section 204 is continued at a predetermined temperature to fluidize the toner base particles and the fine resin particles until the resin film is formed on the toner base particles.

(3)-5 Collecting Step

At the collecting step of step S3*e*, spraying of the substance in liquid form from the spraying section is finished, rotation of the rotary stirring section 204 is stopped, the resin layer-coated toner is ejected outside the apparatus from the powder collecting section 207, and the resin layer-coated toner is collected.

In this way, the resin layer-coated toner is manufactured, but the peripheral speed of the outermost peripheral of the rotary stirring section 204 at the coating step S3 including steps S3*a* to S3*e* is preferably set to 30 m/sec or more, and more preferably to 50 m/sec or more. The outermost peripheral of the rotary stirring section 204 is a part 4*a* of the rotary stirring section 204 that has the longest distance from the axis of the rotary shaft member 218 in the direction perpendicular to the extending direction of the rotary shaft member 218 or the rotary stirring section 204. In a case where the peripheral speed in the outermost peripheral of the rotary stirring section 204 is at 30 m/sec or more at the time of rotation, it is possible to isolate and fluidize the toner base particles. In a case where the peripheral speed in the outermost peripheral is less than 30 m/sec, it is impossible to isolate and fluidize the toner base particles and the fine resin particles, thus making it impossible to uniformly coat the toner base particles with the resin film.

At the coating step S3, it is preferable that the temperature in the powder passage 202 is set to a glass transition temperature of the toner base particle or less. Further, the temperature in the powder passage 202 is more preferably 30° C. or more and a glass transition temperature of the toner base particle or less. The temperature in the powder passage 202 is almost uniform at any part in the powder passage 202 by the flow of the toner base particles. In a case where the temperature in the powder passage 202 exceeds the glass transition temperature of the toner base particle, there is a possibility that the toner base particles in the powder passage 202 are softened excessively and aggregation of the toner base particles is generated. Further, in a case where the temperature in the powder passage 202 is less than 30° C., there is a possibility that the drying speed of a dispersion liquid is made slow and the productivity is lowered. Accordingly, in order to prevent aggregation of the toner base particles, it is necessary that the temperature regulation jacket whose inner diameter is larger than an external diameter of the powder passage tube is disposed at least on a part of the outer side of the powder passage tube and the rotary stirring section 204 and an apparatus is provided that has a function of regulating the temperature by passing a cooling medium or a heating medium through the space thereof so as to maintain the temperature of the powder passage 202 and the rotary stirring section to the glass transition temperature of the toner base particle or less.

As described above, the rotary stirring section 204 includes the rotary disc 219 that is rotated with rotation of the rotary shaft member 216, and the toner base particles and the fine resin particles preferably collide with the rotary disc 219 vertically to the rotary disc 219, and more preferably collide with the rotary shaft member 218 vertically to the rotary disc 219. Whereby, it is possible to stir the toner base particles and the fine resin particles more sufficiently than the case where the toner base particles and the fine resin particles collide with the rotary disc 219 in parallel, thus making it possible to coat the toner base particles with the fine resin particles more uniformly and to further improve yield of the toner uniformly coated with the coating layer.

The substance in liquid form sprayed is preferably gasified to have a constant gas concentration in the powder passage 202. Whereby, the concentration of the gasified substance in the powder passage 202 is kept constant and it is possible to make the drying speed of the substance in liquid form higher than the case where the concentration of the gasified substance is not kept constant, thus making it possible to prevent that the toner particles in which an undried substance in liquid form is remained are adhered to other toner particles and to further suppress aggregation of the toner particles. As a result, it is possible to further improve yield of the toner uniformly coated with the coating layer.

The concentration of the gasified substance measured by a concentration sensor in a gas exhausting section 222 is preferably around 3% or less. In a case where the concentration of the gasified substance is around 3% or less, the drying speed of the substance in liquid form is able to be increased sufficiently, thus making it possible to prevent adhesion of the undried toner base particles in which the substance in liquid form is remained to other toner base particles and to prevent aggregation of the toner base particles. Moreover, the concentration of the gasified substance in the gas exhausting section 222 is more preferably 0.1% or more and 3.0% or less by the concentration sensor. In a case where the spraying speed falls within this range, it is possible to prevent aggregation of the toner base particles without deteriorating the productivity.

The gasified substance is preferably exhausted outside the powder passage through the throughhole 221 so that the gas concentration in the powder passage is kept constant. Whereby, the concentration of the gasified substance in the powder passage is kept constant and it is possible to make the drying speed of the substance in liquid form higher than the case where the concentration of the gasified substance is not kept constant, thus making it possible to prevent that the toner particles in which an undried substance in liquid form is remained are adhered to other toner particles and to further suppress aggregation of the toner particles. As a result, it is possible to further improve yield of the toner uniformly coated with the coating layer.

As described above, the method for manufacturing a toner according to the embodiment uses the rotary stirring apparatus, and the rotary stirring apparatus comprises the circulation section, the temperature regulation section and the spraying section. The spraying section comprises a two-fluid nozzle which sprays a substance in liquid form for assisting adhesion between the toner base particles and the fine resin particles from the liquid pipe and sprays the carrier gas from the air pipe. The two-fluid nozzle comprises the liquid pipe and the air pipe, the liquid pipe is inserted in the air pipe such that an axis of the liquid pipe coincides with an axis of the air pipe, and at least a part of the liquid pipe and the air pipe is fixed such that the centers of those pipes do not move.

In the rotary stirring apparatus, the liquid substance in liquid form for assisting adhesion between the toner base particle and the fine resin particles is sprayed in a constant rate from the two-fluid nozzle while regulating temperature and circulating the toner base particles and the fine resin particles in the powder passage. In this case, the fine resin particles can be plasticized by the synergistic effect of the circulation section and the temperature regulation section, thereby forming a film on the surface of the toner base particle. When the two-fluid nozzle having a structure such that the centers of the liquid pipe and the air pipe do not move is used in the production method of the toner, even though circulating wind, and the circulating toner base particle and fine resin particles collide with the two-fluid nozzle, the centers of the liquid pipe and the air pipe can be prevented from moving. Due to this, the amount of a carrier gas sprayed per unit area is constant and is stabilized in the cross-section of the tip of the air pipe. As a result, the direction of the substance in liquid form sprayed and the spraying amount can be suppressed from being changed, and a stable spraying state can be maintained. Therefore, a liquid concentration in the powder passage can be maintained constant, and a toner having uniform film state and particle size distribution can be manufactured in a stable manner over a long period of time.

The configuration of a rotary stirring apparatus 201 is not limited to the above and various alterations may be added thereto. For example, the temperature regulation jacket may be provided over the outside of the powder flowing section 209 and the stirring section 208, or may be provided in a part of the outside of the powder flowing section 209 or the stirring section 208. In a case where the temperature regulation jacket is provided over the outside of the powder flowing section 209 and the stirring section 208, it is possible to prevent the toner base particles from being adhered to the inner wall of the powder passage 202 more reliably.

The toner manufacturing apparatus as described above can be also obtained by combining a commercially available stirring apparatus and the spraying section. An example of the commercially available stirring apparatus provided with a powder passage and a rotary stirring section includes HYBRIDIZATION SYSTEM (trade name) manufactured by Nara Machinery Co., Ltd. By installing a liquid spraying section in the stirring apparatus, the stirring apparatus is usable as the toner manufacturing apparatus used for the method for manufacturing a toner of the invention.

2. Toner

A toner according to a second embodiment of the invention is manufactured by the method for manufacturing a toner according to the first embodiment. The toner obtained by the method for manufacturing a toner according to the first embodiment has the uniform coated amount of fine resin particles, toner characteristics such as charging characteristics between individual toner particles are uniform. Moreover, the toner of the invention is excellent in durability since an effect of protecting a contained component by the resin layer on the surface of the toner is exhibited. In a case where an image is formed with such a toner, it is possible to obtain an image having high definition and excellent image quality without unevenness in density.

To the toner of the invention, an external additive may be added. As the external additive, heretofore known substances can be used including silica and titanium oxide. It is preferred that these substances be surface-treated with silicone resin and a silane coupling agent. A preferable usage of the external additive is 1 part by weight to 10 parts by weight based on 100 parts by weight of the toner.

3. Developer

A developer according to a third embodiment of the invention includes the toner according to the second embodiment. This makes it possible that a developer has uniform toner characteristics such as charging characteristics between individual toner particles, thus obtaining a developer capable of maintaining excellent development performance. The developer of the embodiment can be used in form of either one-component developer or two-component developer. In the case where the developer is used in form of one-component developer, only the toner is used without carriers while a blade and a fur brush are used to effect the fictional electrification at a developing sleeve so that the toner is attached onto the sleeve, thereby conveying the toner to perform image formation. Further, in the case where the developer is used in form or two-component developer, the toner of a second embodiment is used together with a carrier. Since the toner of the invention has uniform toner characteristics such as charging characteristics between individual toner particles, it is possible to stably form an image having high definition and excellent image quality without unevenness in density.

(Carrier)

As the carrier, heretofore known substances can be used including, for example, single or complex ferrite composed of iron, copper, zinc, nickel, cobalt, manganese, and chromium; a resin-coated carrier having carrier core particles whose surfaces are coated with coating substances; or a resin-dispersion carrier in which magnetic particles are dispersed in resin. As the coating substance, heretofore known substances can be used including polytetrafluoroethylene, a monochloro-trifluoroethylene polymer, polyvinylidene-fluoride, silicone resin, polyester, a metal compound of di-tertiary-butylsalicylic acid, styrene resin, acrylic resin, polyamide, polyvinyl butyral, nigrosine, aminoacrylate resin, basic dyes or lakes thereof, fine silica powder, and fine alumina powder. In addition, the resin used for the resin-dispersion carrier is not limited to particular resin, and examples thereof include styrene-acrylic resin, polyester resin, fluorine resin, and phenol resin. Both of the coating substance in the resin-coated carrier and the resin used for the resin-dispersion carrier are preferably selected according to the toner components. Those substances and resin listed above may be used each alone, and two or more thereof may be used in combination.

A particle of the carrier preferably has a spherical shape or flattened shape. A particle size of the carrier is not limited to a particular diameter, and in consideration of forming higher-quality images, the particle size of the carrier is preferably 10 μm to 100 μm and more preferably 20 μm to 50 μm. Further, the volume resistivity of the carrier is preferably $10^8$ Ω·cm or more, and more preferably $10^{12}$ Ω·cm or more.

The volume resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container as just stated. When an electric field of 1,000 V/cm is generated between the weighs and a bottom electrode of the container by application of voltage, a current value is read. The current value indicates the resistivity of the carrier. When the resistivity of the carrier is low, electric charges will be injected into the carrier upon application of bias voltage to a developing sleeve, thus causing the carrier particles to be more easily attached to the photoreceptor. In this case, the breakdown of bias voltage is more liable to occur.

Magnetization intensity (maximum magnetization) of the carrier is preferably 10 emu/g to 60 emu/g and more preferably 15 emu/g to 40 emu/g. The magnetization intensity depends on magnetic flux density of a developing roller. Under the condition of ordinary magnetic flux density of the developing roller, however, no magnetic binding force work on the carrier having the magnetization intensity less than 10 emu/g, which may cause the carrier to spatter. The carrier having the magnetization intensity larger than 60 emu/g has bushes which are too large to keep the non-contact state with the image bearing member in the non-contact development or to possibly cause sweeping streaks to appear on a toner image in the contact development.

A use ratio of the toner to the carrier in the two-component developer is not limited to a particular ratio, and the use ratio is appropriately selected according to kinds of the toner and carrier. To take the resin-coated carrier (having density of 5 $g/cm^2$ to 8 $g/cm^2$) as an example, the usage of the toner may be determined such that a content of the toner in the developer is 2% by weight to 30% by weight and preferably 2% by weight to 20% by weight of the total amount of the developer. Further, in the two-component developer, coverage of the carrier with the toner is preferably 40% to 80%.

4. Image Forming Apparatus

Figure 8:
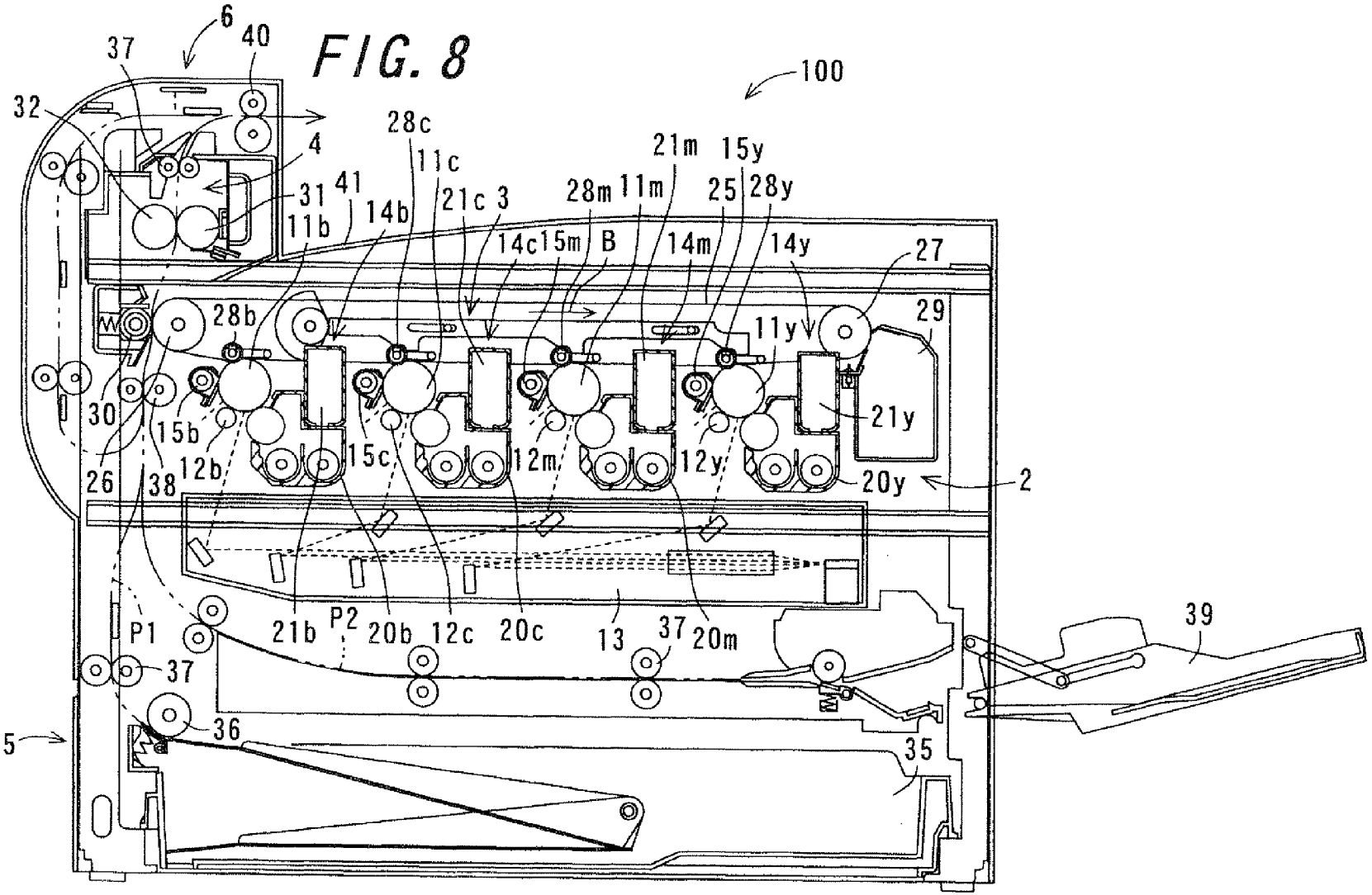
FIG. 8 is a sectional view schematically showing a configuration of an image forming apparatus according to a fourth embodiment of the invention.

FIG. 8 is a sectional view schematically showing a configuration of an image forming apparatus 100 according to a fourth embodiment of the invention. The image forming apparatus 1 is a multifunctional system which combines a copier function, a printer function, and a facsimile function. In the image forming apparatus 100, according to image information transmitted thereto, a full-color or black-and-white image is formed on a recording medium. To be specific, three print modes, i.e., a copier mode, a printer mode, and a facsimile mode are available in the image forming apparatus 100, one of which print modes is selected by a control unit (not shown) in response to an operation input given by an operating section (not shown) or a print job given by a personal computer, a mobile computer, an information record storage medium, or an external equipment having a memory unit.

The image forming apparatus 100 includes a photoreceptor drum 11, a toner image forming section 2, a transfer section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The toner image forming section 2 includes a charging section 12, an exposure unit 13, a developing device 14, and a cleaning unit 15. The charging section 12 and the exposure unit 13 functions as a latent image forming section. The charging section 12, the developing device 14, and the cleaning unit 15 are disposed in the order just stated around the photoreceptor drum 11. The charging section 12 is disposed vertically below the developing device 14 and the cleaning unit 15.

The photoreceptor drum 11 is a roller-like member provided so as to be capable of rotationally driving around an axis by a rotary driving section (not shown) and on the surface of which an electrostatic latent image is formed. The rotary driving section of the photoreceptor drum 11 is controlled by a controlling section that is realized by a central processing unit (CPU). The photoreceptor drum 11 is comprised of a conductive substrate (not shown) and a photosensitive layer formed on the surface of the conductive substrate. The conductive substrate may be various shapes including a cylindrical shape, a columnar shape, or a thin film sheet shape, for example. Among them, the cylindrical shape is preferable. The conductive substrate is formed by a conductive material.

As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. is formed on a film-like substrate such as a synthetic resin film, a metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the chargeability of the photosensitive layer can be enhanced under at least either a low temperature circumstance or a low humidity circumstance. Further, a laminated photoreceptor is also applicable which has a highly-durable three-layer structure having a photoreceptor surface-protecting layer provided on the top layer.

The charge generating layer contains as a main substance a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium, dyes; and azo pigments having carbazole skeleton, styryistilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination.

The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resin may be used each alone or optionally two or more of them may be used in combination.

The charge generating layer can be formed by dissolving or dispersing an appropriate amount of a charge generating substance, binder resin and, optionally, a plasticizer, a sensitizer, etc., respectively in an appropriate organic solvent which is capable of dissolving or dispersing the substances described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm and more preferably from 0.1 μm to 2.5 μm.

The charge transporting layer stacked over the charge generating layer contains as essential substances a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis 4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer.

As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resin may be used each alone, or two or more of them may be used in combination.

The charge transporting layer preferably contains an antioxidant together with the charge transporting substance and the binder resin for charge transporting layer. Also for the antioxidant, substances used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer.

The charge transporting layer can be formed by dissolving or dispersing an appropriate amount of a charge transporting substance, hinder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm.

Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 longitudinally along the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum. It is also possible to use a contact-charging type charger such as a charging brush or a magnetic brush.

The exposure unit 13 is disposed so that a light beam corresponding to each color information emitted from the exposure unit 13 passes between the charging section 12 and the developing device 14 and reaches the surface of the photoreceptor drum 11. In the exposure unit 13, the image information is converted into light beams corresponding to each color information of black, cyan, magenta, and yellow, and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser-emitting portion and a plurality of reflecting mirrors. The other usable examples of the exposure unit 13 may include an LED array or a unit in which a liquid-crystal shutter and a light source are appropriately combined with each other.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus 1 of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of the charging section. The degraded surface part is, however, worn away by abrasion through the cleaning unit 15 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of toner image forming operations just described are repeatedly carried out.

The transfer section 3 is disposed above the photoreceptor drum 11 and includes the intermediate transfer belt 25, a driving roller 26, a driven roller 27, an intermediate transferring roller 28*b*, 28*c*, 28*m*, 28*y*, a transfer belt cleaning unit 29, and a transferring roller 30. The intermediate transfer belt 25 is an endless belt supported around the driving roller 26 and the driven roller 2 with tension, thereby forming a loop-shaped travel path. The intermediate transfer belt 25 rotates in an arrow B direction. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 with the intermediate transfer belt 25 interposed therebetween, and capable of rotating around its own axis by a drive mechanism (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25.

When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transferring roller 28 which is disposed opposite to the photoreceptor drum 11 with the intermediate transfer belt 25 interposed therebetween, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image.

The transfer belt cleaning unit 29 is disposed opposite to the driven roller 27 with the intermediate transfer belt 25 interposed therebetween so as to come into contact with an outer circumferential surface of the intermediate transfer belt 25. When the intermediate transfer belt 25 contacts the photoreceptor drum 11, the toner is attached to the intermediate transfer belt 25 and may cause contamination on a reverse side of the recording medium, and therefore the transfer belt cleaning unit 29 removes and collects the toner on the surface of the intermediate transfer belt 25.

The transferring roller 30 is disposed in pressure-contact with the driving roller 26 with the intermediate transfer belt 25 interposed therebetween, and capable of rotating around its own axis by a drive mechanism (not shown). In a pressure-contact portion (a transfer nip region) between the transferring roller 30 and the driving roller 26, a toner image which has been borne by the intermediate transfer belt 25 and thereby conveyed to the pressure-contact portion is transferred onto a recording medium fed from the later-described recording medium feeding section 5. The recording medium bearing the toner image is fed to the fixing section 4.

In the transfer section 3, the toner image is transferred from the photoreceptor drum 11 onto the intermediate transfer belt 25 in the pressure-contact portion between the photoreceptor drum 11 and the intermediate transferring roller 28, and by the intermediate transfer belt 25 rotating in the arrow B direction, the transferred toner image is conveyed to the transfer nip region where the toner image is transferred onto the recording medium.

The fixing section 4 is provided downstream of the transfer section 3 along a conveyance direction of the recording medium, and contains a fixing roller 31 and a pressure roller 32. The fixing roller 31 can rotate by a drive mechanism (not shown), and heats and fuses the toner constituting an unfixed toner image borne on the recording medium. Inside the fixing roller 31 is provided a heating portion (not shown). The heating portion heats the heating roller 31 so that a surface of the heating roller 31 has a predetermined temperature (heating temperature). For the heating portion, a neater, a halogen lamp, and the like device can be used, for example. The heating portion is controlled by the fixing condition controlling portion.

In the vicinity of the surface of the fixing roller 31 is provided a temperature detecting sensor (not shown) which detects a surface temperature of the fixing roller 31. A result detected by the temperature detecting sensor is written to a memory portion of the later-described control unit. The pressure roller 32 is disposed in pressure-contact with the fixing roller 31, and supported so as to be driven to rotate by the rotation of the fixing roller 31. The pressure roller 32 fixes the toner image onto the recording medium in cooperation with the fixing roller 31. At this time, the pressure roller 32 helps the toner image in the fused state by the heat from the fixing roller 31, to be fixed onto the recording medium by pressing the toner image against the recording medium by the fixing roller 31. A pressure-contact portion between the fixing roller 31 and the pressure roller 32 is a fixing nip region.

In the fixing section 4, the recording medium onto which the toner image has been transferred in the transfer section 3 is nipped by the fixing roller 31 and the pressure roller 32 so that when the recording medium passes through the fixing nip region, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 100 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path P1. The conveying rollers 37 are a pair of roller members disposed in pressure-contract with each other, and convey the recording medium to the registration rollers 38. The registration rollers 38 are a pair of roller members disposed in pressure-contact with each other, and feed to the transfer nip region the recording medium fed from the conveying rollers 37 in synchronization with the conveyance of the toner image borne on the intermediate transfer belt 25 to the transfer nip region. The manual paper feed tray 39 is a device for storing recording mediums which are different from the recording mediums stored in the automatic paper feed tray 35 and may have any size and which are to be taken into the image forming apparatus 100. The recording medium taken in from the manual paper feed tray 39 passes through a paper conveyance path P2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip region in synchronization with the conveyance of the toner image borne on the intermediate transfer belt 25 to the transfer nip region.

The discharging section 6 includes the conveying rollers 37, discharging rollers 40, and a catch tray 41. The conveying rollers 37 are disposed downstream of the fixing nip region along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 1. The catch tray 41 stores the recording medium onto which the image has been fixed.

The image forming apparatus 100 includes a control unit (not shown). The control unit is disposed, for example, in an upper part of an internal space of the image forming apparatus 100, and contains a memory portion, a computing portion, and a control portion. To the memory portion of the control unit are input, for example, various set values obtained by way of an operation panel (not shown) disposed on the upper surface of the image forming apparatus 100, results detected from a sensor (not shown) etc. disposed in various portions inside the image forming apparatus 100, and image Information obtained from an external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disk drive (HDD). For the external equipment, it is possible to use electrical and electronic devices which can form or obtain the image information and which can be electrically connected to the image forming apparatus 100. Examples of the external equipment include a computer, a digital camera, a television receiver, a video recorder, a DVD (digital versatile disc) recorder, an HDDVD (high-definition digital versatile disc), a Blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus 100.

5. Developing Device

Figure 9:
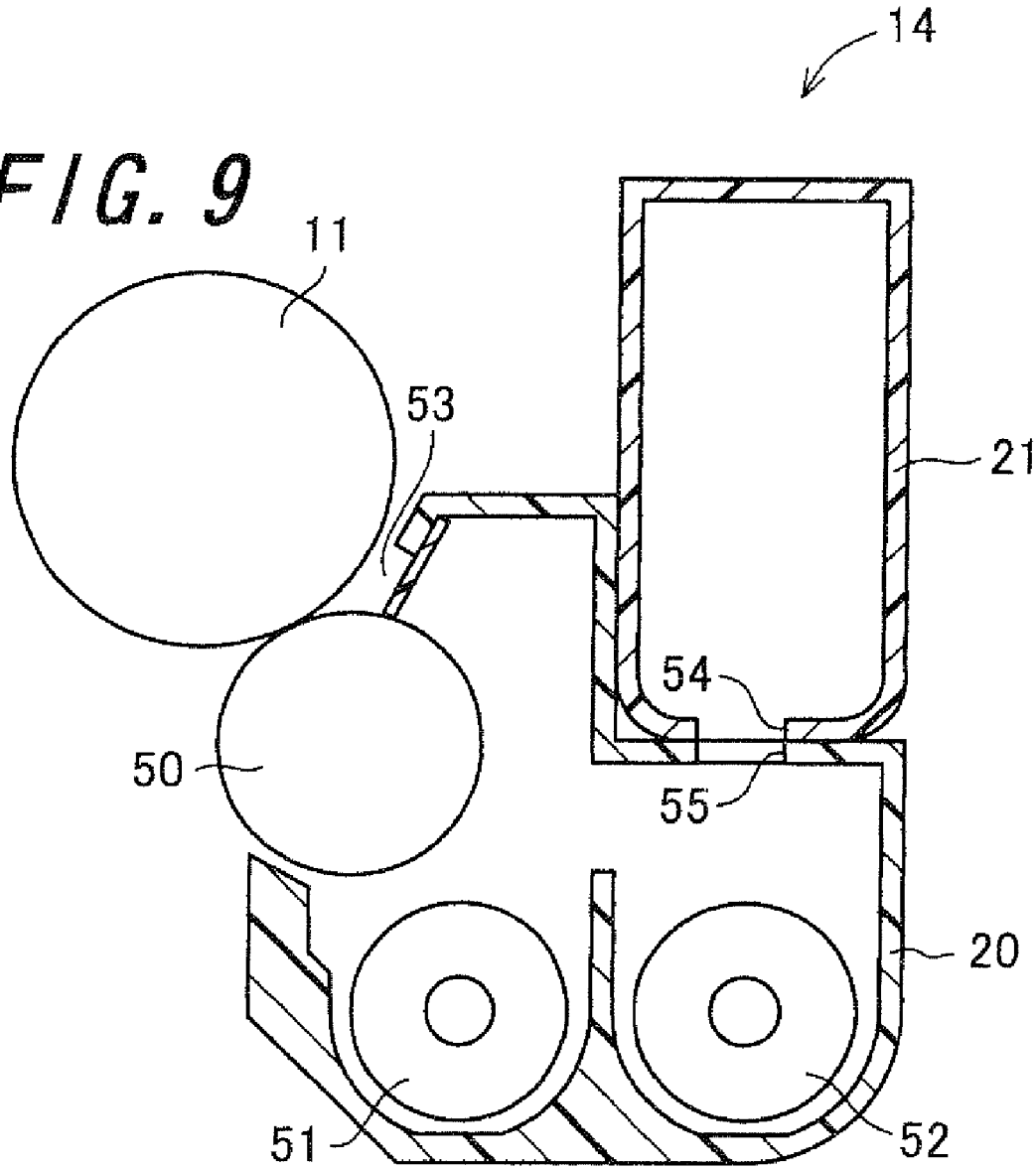
FIG. 9 is a schematic view schematically showing a developing device provided in the image forming apparatus shown in FIG. 8.

FIG. 9 is a schematic view schematically showing the developing device 14 provided in the image forming apparatus 100 shown in FIG. 8. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller 50, a supplying roller 51, and an agitating roller 52. Moreover, a screw member may be stored instead of the roller-like member. The developing device 14 of this embodiment stores the toner of the above embodiment in the developing tank 20 as a toner.

The developing tank 20 has an opening 53 in a side face thereof opposed to the photoreceptor drum 11. The developing roller 50 is rotatably provided at such a position as to face the photoreceptor drum 11 through the opening 53 just stated. The developing roller 50 is a roller-shaped member for supplying a toner to the electrostatic latent image on the surface of the photoreceptor drum 11 in a pressure-contact portion or most-adjacent portion between the developing roller 50 and the photoreceptor drum 11. In supplying the toner, to a surface of the developing roller 50 is applied potential whose polarity is opposite to polarity of the potential of the charged toner, which serves as development bias voltage. By so doing, the toner on the surface of the developing roller 50 is smoothly supplied to the electrostatic latent image. Furthermore, an amount of the toner being supplied to the electrostatic latent image which amount is referred to as "toner attachment amount") can be controlled by changing a value of the development bias voltage.

The supplying roller 51 is a roller-shaped member which is rotatably disposed so as to face the developing roller 50 and used to supply the toner to the vicinity of the developing roller 50.

The agitating roller 52 is a roller-shaped member which is rotatably disposed so as to face the supplying roller 51 and used to feed to the vicinity of the supplying roller 51 the toner which is newly supplied from the toner hopper 21 into the developing tank 20. The toner hopper 21 is disposed so as to communicate a toner replenishment port 54 formed in a vertically fewer part of the toner hopper 21, with a toner reception port 55 formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

As described above, since the developing device 14 develops a latent image using the developer of the invention, it is possible to stably form a high-definition toner image on the photoreceptor drum 11. As a result, it is possible to form a high-quality image stably.

Further, according to the invention, the image forming apparatus 100 is realized by including the photoreceptor drum 11 on which a latent image is formed, the charging section 12 that forms the latent image on the photoreceptor drum 11, the exposure unit 13, and the developing device 14 of the invention capable of forming a high-definition toner image on the photoreceptor drum 11 as described above. By forming an image with such an image forming apparatus 100, it is possible to form an image having high definition and excellent image quality without unevenness in density.

EXAMPLES

Hereinafter, referring to examples and comparative examples, the invention will be specifically described. In the following description, unless otherwise noted, "parts" and "%" represent "parts by weight" and "% by weight" respectively.

(Property Measurement)

[Glass Transition Temperature of Binder Resin and Toner Base Particle]

Using a differential scanning calorimeter (trade name: DSC220, manufactured by Seiko Instruments & Electronics Ltd.), 1 g of specimen was heated at a temperature increasing rate of 10° C./min to measure a DSC curve based on Japanese Industrial Standards (JIS) K7121-1987. A temperature at an intersection of a straight line that was elongated toward a low-temperature side from a base line on the high-temperature side of an endothermic peak corresponding to glass transition of the obtained DSC curve and a tangent line that was drawn so that a gradient thereof was maximum against a curve extending from a rising part to a top of the peak was obtained as the glass transition temperature ($T_g$).

[Softening Temperature of Binder Resin]

Using a flow characteristic evaluation apparatus (trade name: FLOW TESTER CFT-100C, manufactured by Shimadzu Corporation), 1 g of specimen was heated at a temperature increasing rate of 6° C./min, under load of 20 kgf/cm$^2$ ($19.6\times10^5$ Pa) so that the specimen was pushed out of a dye (nozzle opening diameter of 1 mm and length of 1 mm) and a temperature at the time when a half of the specimen had flowed out of the dye was obtained as the softening temperature ($T_m$).

[Melting Point of Release Agent]

Using the differential scanning calorimeter (trade name: DSC220, manufactured by Seiko Instruments & Electronics Ltd.), 1 g of specimen was heated from a temperature of 20 up to 200° C. at a temperature increasing rate of 10° C./min, and then an operation of rapidly cooling down from 200° C. to 20° C. was repeated twice, thus measuring a DSC curve. A temperature at a top of an endothermic peak corresponding to the melting on the DSC curve measured at the second operation, was obtained as the melting point of the release agent.

[Volume Average Particle Sizes of Toner Base Particle, Fine Resin Particle and Toner]

To 50 ml of electrolyte (trade name: ISOTON-II, manufactured by Beckman Coulter, Inc.), 20 mg of specimen and 1 ml of sodium alkylether sulfate ester were added, and a thus-obtained admixture was subjected to dispersion processing of an ultrasonic distributor (trade name: desktop two-frequency ultrasonic Cleaner VS-D100, manufactured by AS ONE Corporation) for three minutes at an ultrasonic frequency of 20 kHz, thereby preparing a specimen for measurement. The measurement sample was analyzed by a particle size distribution-measuring device: MULTISIZER III (trade name) manufactured by Beckman Coulter, Inc. under the conditions that an aperture diameter was 100 μm and the number of particles for measurement was 50,000 counts. A volume particle size distribution of the sample particles was thus obtained from which the volume average particle size was then determined.

[Two-Fluid Nozzle]

The following two-fluid nozzles 1 to 6 were used as the two-fluid nozzle. A mesh material was used as the fixing member. An adhesion preventive member having a trapezoidal cross-section shown in FIGS. 5 and 6 was used as the adhesion preventive member.

A size of the two-fluid nozzle, the presence or absence of the fixing member, a position of the fixing member from the tip of the air pipe, the presence or absence of the adhesion preventive member, and a size of the adhesion preventive member are shown in Table 1. An inner diameter and a length of the liquid pipe and the air pipe are shown as a size of the two-fluid nozzle. The side 235, the length 236, the height 237 and angles $\theta_1$ and $\theta_2$ shown in FIG. 6 are shown as a size of the adhesion preventive member.

TABLE 1

| | Liquid pipe | | Air pipe | | Fixing member | | Adhesion preventive member | | | | | |
|---|---|---|---|---|---|---|---|---|---|---|---|---|
| Kind of two-fluid nozzle | Inner diameter (mm) | Length (mm) | Inner diameter (mm) | Length (mm) | Presence or absence of fixing member | Position from tip of air pipe (mm) | Presence or absence of adhesion preventive member | Side 235 (mm) | Side 236 (mm) | Height 237 (mm) | Angle $\theta_1$ (°) | Angle $\theta_2$ (°) |
| 1 | 0.7 | 130.5 | 2 | 130 | Presence | 3 | Absence | — | — | — | — | — |
| 2 | 1.5 | 130.5 | 3 | 130 | Presence | 3 | Absence | — | — | — | — | — |
| 3 | 0.7 | 130.5 | 2 | 130 | Presence | 3 | Presence | 10.5 | 7 | 1.25 | 20 | 35 |
| 4 | 1.5 | 130.5 | 3 | 130 | Presence | 3 | Presence | 10.5 | 7 | 1.25 | 20 | 35 |
| 5 | 0.7 | 130.5 | 2 | 130 | Absence | 3 | Absence | — | — | — | — | — |
| 6 | 1.5 | 130.5 | 3 | 130 | Absence | 3 | Absence | — | — | — | — | — |

Example 1

[Toner Base Particle Preparation Step S1]

Raw materials of the toner base particles and addition amounts thereof were as follows:

| | |
|---|---|
| Polyester resin (trade name: DIACRON, manufactured by Mitsubishi Rayon Co., Ltd., glass transition temperature of 55° C., softening temperature of 100° C.) | 87.5% (100 parts) |
| C.I. Pigment Blue 15:3 | 5.0% (5.7 parts) |
| Release agent (Carunauba Wax, melting point of 82° C.) | 6.0% (6.9 parts) |
| Charge control agent (trade name: Bontron E84, manufactured by Orient Chemical Industries, Ltd.) | 1.5% (1.7 parts) |

After pre-mixing each of the constituent materials described above by a Henschel mixer (trade name: FM20C, manufactured by Mitsui Mining Co., Ltd.), the obtained mixture was melt and kneaded by a twin-screw extruder (trade name: PCM65 manufactured by Ikegai, Ltd.). After coarsely pulverizing the melt-kneaded material by a cutting mill (trade name: VM-16, manufactured by Orient Co., Ltd.), it was finely pulverized by a jet mill (manufactured by Hosokawa Micron Corporation) and then classified by a pneumatic classifier (manufactured by Hosokawa Micron Corporation) to prepare toner base particles with a volume average particle size of 6.5 μm and a glass transition temperature of 56° C.

[Fine Resin Particle Preparation Step S2]

A polymer obtained by polymerizing styrene, butyl acrylate and acrylic acid was freeze-dried. Thus, styrene/butyl acrylate/acrylic acid copolymer fine particles (glass transition temperature: 65° C., softening temperature: 117° C.) having a volume average particle size of 0.15 μm were obtained as the fine resin particles.

[Coating Step S3]

By an apparatus in which a two-fluid nozzle is installed in Hybridization system (trade name: NHS-1 Model, manufactured by Nara Machinery Co., Ltd.) in accordance with the apparatus shown in FIGS. 2 and 3, ethanol was sprayed as a substance in a form of liquid in a state where toner base particles and fine resin particles were stirred and fluidized. For a liquid spraying section, the one that is connected so as to feed the substance in liquid form quantitatively to the two-fluid nozzle 1 shown in Table 1 through a liquid feeding pump (trade name: SP11-12, manufactured by FLOM Co., Ltd.) is usable. The spraying speed of the substance in liquid form and the exhausting speed of gas can be observed with a commercially available gas detector (product name: XP-3110, manufactured by New Cosmos Electric Co., Ltd.).

The temperature regulation jacket was provided over the entire surface of the powder flowing section and the wall surface of the stirring section and regulated so that a temperature of the powder flowing section and the stirring section became 55° C. A temperature sensor was installed in the powder passage. In the above-described apparatus, a peripheral speed in the outermost peripheral of the rotary stirring section of the Hybridization system was 100 m/sec at the fine resin particle adhering step to the surface of toner base particles. The peripheral speed was also 100 m/sec at the spraying step and the film-forming step. Moreover, an installation angle of the two-fluid nozzle was set so that an angle formed by the liquid spraying direction and the powder flowing direction (hereinafter referred to as "spraying angle") is in parallel (0°). After stirring and mixing 100 parts by weight of toner base particles and 10 parts by weight of fine resin particles which were thus prepared for five minutes by the apparatus, ethanol as the substance in liquid form was sprayed for thirty minutes at spraying speed of 1.0 g/min and an air flow of 5 L/min to film-form the fine resin particles on the surface of the toner base particles. Then, spraying of the ethanol was stopped, followed by stirring for ten minutes, to obtain a toner of Example 1. In this case, an exhaust concentration of the gasified substance exhausted through the through-hole and the gas exhausting section was stable at about 2.8 Vol %. Moreover, the air flow into the apparatus was 10 L/min in total with the air flow from the two-fluid nozzle by adjusting the air flow from the rotary shaft section into the apparatus to 5 L/min.

Example 2

A toner of Example 2 was obtained in the same manner as in Example 1, except that the two-fluid nozzle 2 was used in place of the two-fluid nozzle 1 in the coating step S3.

Example 3

A toner of Example 3 was obtained in the same manner as in Example 1, except that the two-fluid nozzle 3 was used in place of the two-fluid nozzle 1 in the coating step S3.

Example 4

A toner of Example 4 was obtained in the same manner as in Example 1, except that the two-fluid nozzle 4 was used in place of the two-fluid nozzle 1 in the coating step S3.

Example 5

A toner of Example 5 was obtained in the same manner as in Example 3, except that the temperature regulation jacket was not provided on the entire surface of the powder flowing section and the wall surface of the stirring section, but was provided on the powder flowing section and a part of the wall surface of the stirring section, in the coating step S3.

Comparative Example 1

A toner of Comparative Example 1 was obtained in the same manner as in Example 1, except that the two-fluid nozzle 5 was used in place of the two-fluid nozzle 1 in the coating step S3.

Comparative Example 2

A toner of Comparative Example 2 was obtained in the same manner as in Example 1, except that the two-fluid nozzle 6 was used in place of the two-fluid nozzle 1 in the coating step S3.

Comparative Example 3

A toner of Comparative Example 3 was obtained in the same manner as Example 1 except for that 30 g of ethanol was introduced for thirty minutes using a syringe as the spraying section for the substance in liquid form in place of spraying ethanol for thirty minutes at the spraying speed of 1.0 g/min at the ethanol spraying step.

(Evaluation)

An evaluation of yield, coarse powder content and coating uniformity was conducted as follows for the obtained toners of Examples 1 to 5 and Comparative Examples 1 to 3.

<Yield>

The toner yield was calculated by the following formula (1) and the yield of the toners manufactured by the manufacturing methods of the Examples 1 to 5 and Comparative Examples 1 to 3 was evaluated.

$$\text{Toner yield (\%)}=\{\text{Weight of collected toner particles}/(\text{Weight of input toner base particles}+\text{Weight of solid fine resin particles})\}\times 100 \quad (1)$$

An evaluation criterion is as follows:

Good: Favorable. Calculated toner yield is 90% or more.

Poor: No good. The calculated toner yield is less than 90%.

[Coarse Powder Content]

A particle size of the toners obtained in Examples 1 to 5 and Comparative Examples 1 to 3 was measured using a particle size distribution analyzer (trade name: Multisizer 3, manufactured by Beckman Coulter, Inc.), and the content of toner particles of 12 μm or more (hereinafter referred to as "coarse powder") was obtained from the volume particle size distribution of the toners of Examples 1 to 5 and Comparative Examples 1 to 3.

An evaluation criterion is as follows.

Good: Favorable. Coarse powder content in toner is less than 3%.

Not bad: No practical problem. Coarse powder content in toner is from 3% to less than 5%.

Poor: No good. Coarse powder content in toner is 10% or more.

(Coating Uniformity)

To 100 parts by weight of each of the toners obtained in Examples 1 to 5 and Comparative Examples 1 to 3, 1.0 part by weight of silica particles having an average primary particle size of 20 nm hydrophobicized with a silane coupling agent was externally added. Using the toner having silica externally added thereto, uniformity of a coating film was evaluated by the presence or absence of aggregates after storage at high temperature. 20 g of the toner was put in a plastic container and sealed, and allowed to stand therein at 50° C. for 48 hours. The toner was taken out of the container, and sieved with a 200 mesh sieve. The weight of the residual toner on the sieve was measured, and the residual amount which is the proportion of its weight to the total weight of the toner was obtained. The amount was evaluated by the following standard. A smaller value shows that the toner does not cause blocking and storage stability is better.

An evaluation criterion is as follow.

Good: Slight amount of aggregate. Residual amount is less than 3%.

Poor: Small amount of aggregate. Residual amount is 3% or more.

[Comprehensive Evaluation]

The comprehensive evaluation of the methods of manufacturing a toner according to Examples 1 to 5 and Comparative Examples 1 to 3 was conducted on the basis of the evaluations of the above-described yield, coarse powder content and coating uniformity.

The evaluation standard is as follows.

Good: Favorable. All evaluation results are rated as "Good".

Not Bad: Fair. The evaluation result of yield or coating uniformity is rated as "Good", but coarse powder content is rated as "Not Bad".

Poof: No good. The evaluation result of yield, coarse powder content or coating uniformity is rated as "Poor".

The evaluation results and the comprehensive evaluation results of the methods of manufacturing a toner according to Examples 1 to 5 and Comparative Examples 1 to 3 are shown in Table 2.

TABLE 2

| | Peripheral speed of Outermost periphery (m/sec) | Kind of two-fluid nozzle | Spraying liquid | Spraying rate (g/min) | Jacket temperature regulation: Powder passage | Jacket temperature regulation: Wall surface of stirring section | Temperature of powder flowing section (° C.) | Temperature of stirring section (°) | Spraying angle (°) | Gas exhaust |
|---|---|---|---|---|---|---|---|---|---|---|
| Ex. 1 | 100 | 1 | Ethanol | 1 | Done | Done | 55 | 55 | 0 | Done |
| Ex. 2 | 100 | 2 | Ethanol | 1 | Done | Done | 55 | 55 | 0 | Done |
| Ex. 3 | 100 | 3 | Ethanol | 1 | Done | Done | 55 | 55 | 0 | Done |
| Ex. 4 | 100 | 4 | Ethanol | 1 | Done | Done | 55 | 55 | 0 | Done |
| Ex. 5 | 100 | 3 | Ethanol | 1 | Done | Partially done | 55 | 55 | 0 | Done |
| Comp. Ex. 1 | 100 | 5 | Ethanol | 1 | Done | Done | 55 | 55 | 0 | Done |
| Comp. Ex. 2 | 100 | 6 | Ethanol | 1 | Done | Done | 55 | 55 | 0 | Done |
| Comp. Ex. 3 | 100 | Syringe | Ethanol | 1 | Done | Done | 55 | 55 | 0 | Done |

| | Yield: Yield (%) | Yield: Evaluation | Coarse powder content: Content (%) | Coarse powder content: Evaluation | Coating uniformity: Residual amount (%) | Coating uniformity: Evaluation | Comprehensive evaluation |
|---|---|---|---|---|---|---|---|
| Ex. 1 | 95 | Good | 1.00 | Good | 0 | Good | Good |
| Ex. 2 | 95 | Good | 2.35 | Good | 0 | Good | Good |
| Ex. 3 | 96 | Good | 0.75 | Good | 0 | Good | Good |
| Ex. 4 | 96 | Good | 1.22 | Good | 0 | Good | Good |
| Ex. 5 | 95 | Good | 2.85 | Good | 0 | Good | Good |
| Comp. Ex. 1 | 95 | Good | 4.21 | Not Bad | 0 | Good | Not Bad |
| Comp. Ex. 2 | 96 | Good | 4.77 | Not Bad | 0 | Good | Not Bad |
| Comp. Ex. 3 | 60 | Poor | 10.35 | Poor | 28 | Poor | Poor |

As shown in Table 2, in Examples 1 to 5 using the two-fluid nozzle containing the fixing member, the yield of a toner is high, the coarse powder content is low and the coating uniformity is good. In Comparative Examples 1 and 2 using the two-fluid nozzle which does not contain a fixing member, the coarse powder content is higher as compared with Examples 1 to 5. In Comparative Example 3 which did not use a two-fluid nozzle, the yield of a toner is low, the coarse powder content is high and the coating uniformity is deteriorated. It is understood from these results that the method for manufacturing a toner according to the invention is excellent.

In Examples 3 and 4 using the two-fluid nozzle having the adhesion preventive member provided thereon, the yield is higher and the coarse powder content is lower, as compared with Examples 1 and 2 using the two-fluid nozzle to which the adhesion preventive member is not provided. In Example 3 in which the powder passage and the whole of the wall surface of the stirring section were regulated to a given temperature, the coarse powder content is decreased as compared with Example 5 in which the powder passage and a part of the wall surface of the stirring section was regulated to a given temperature. In Example 1 in which the ratio of the inner diameter of the air pipe to the inner diameter of the liquid pipe is 1:3, the coarse powder content is lower as compared with Example 2 in which the ratio is 1:2, and better result was obtained. In Example 3 in which the ratio is about 1:3, the coarse powder content is lower as compared with Example 4 in which the ratio is 1:2, and better result was obtained. This is because the ratio of 1:3 is optimum, the spraying state of the substance in liquid form is better than Examples 2 and 4, and the aggregate was difficult to be generated. In Examples 1 to 5, the result of Example 3 in which the ratio of the inner diameter of the air pipe to the inner diameter of the liquid pipe is about 1:3 was best.

The invention may be embodied in other specific forms without departing from the spirit or essential characteristics thereof. The embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for manufacturing a resin layer-coated toner using a rotary stirring apparatus that comprises:

a circulation section which repeatedly circulates a toner base particle and fine resin particles in a powder passage comprising a rotary stirring chamber and a circulation pipe by a rotary stirring section comprising a rotary disk having rotating vanes provided on a circumference thereof and a rotary shaft and returns those particles to the rotary stirring chamber;

a temperature regulation section which is provided in at least a part of the powder passage and regulates the temperature in the powder passage and the temperature of the rotary stirring section to a given temperature; and a spraying section comprising a two-fluid nozzle which sprays a substance in liquid form for assisting adhesion between the toner base particle and the fine resin particles from a liquid pipe and sprays a carrier gas from an air pipe, the two-fluid nozzle comprising a liquid pipe and an air pipe, the liquid pipe being inserted in the air pipe such that an axis of the liquid pipe coincides with an axis of the air pipe, and at least a part of the liquid pipe and the air pipe being fixed such that centers of those pipes do not move, the method comprising:

spraying the substance in liquid form in a constant rate from the two-fluid nozzle while regulating the temperature and circulating the toner base particle and the fine resin particles, in the powder passage, and thereby forming a film on a surface of the toner base particle.

2. The method of claim 1, comprising:

a temperature regulation step of regulating the temperature in the powder passage and the temperature of the rotary stirring section to a given temperature by a temperature regulation section;

a fine resin particle adhesion step of introducing the toner base particle and the fine resin particles into the powder passage in which the rotary stirring section is rotated, thereby adhering the fine resin particles to the surface of the toner base particle;

a spraying step of spraying a substance in liquid form which plasticizes the toner base particle and the fine resin particles to those particles in a fluidized state by a carrier gas; and a film-forming step of continuing rotation of the rotary stirring section until the fine resin particles adhered to the toner base particle get soft and form a film, thereby fluidizing the toner base particle and the fine resin particles, wherein the temperature in a whole powder passage and the temperature of the rotary stirring section are regulated to a given temperature by the temperature regulation section in the temperature regulation step.

3. The method of claim 1, wherein an adhesion preventive member having a given thickness in an outward direction of a radius of a peripheral surface of the air pipe is provided at the tip of the air pipe.

4. The method of claim 3, wherein a cross-section of the adhesion preventive member in a direction of axis of the air pipe is trapezoid, and of mutually parallel two sides of the trapezoid, a longer side is in contact with the periphery of the air pipe.

5. The method of claim 1, wherein the substance in liquid form is sprayed by the spraying section after flowing speed of the toner base particle and the fine resin particles is stabilized at the spraying step.

6. The method of claim 1, wherein the substance in liquid form sprayed at the spraying step is gasified to have a constant gas concentration in the powder passage.

7. The method of claim 6, wherein the gasified substance is exhausted outside the powder passage to have a constant gas concentration in the powder passage.

8. The method of claim 1, wherein the substance in liquid form includes at least an alcohol.

* * * * *